US006006674A

United States Patent [19]

Ahmadian et al.

[11] Patent Number: 6,006,674

[45] Date of Patent: Dec. 28, 1999

[54] SELF-STEERING RAILWAY TRUCK

[75] Inventors: Mehdi Ahmadian, Blacksburg, Va.; Laurence William Gray, Kingston, Canada; Dean Zeal McGrew; William Anthony Kurtzhals, both of Erie, Pa.; James Harry Whitehill, Wattsburg, Pa.; Jennifer Lynn Jaramillo, Fuquay-Variena, N.C.

[73] Assignee: General Electric Company, Erie, Pa.

[21] Appl. No.: 08/966,503

[22] Filed: Nov. 10, 1997

Related U.S. Application Data

[62] Division of application No. 08/743,060, Nov. 4, 1996, Pat. No. 5,746,135, which is a division of application No. 08/555,569, Nov. 8, 1995, Pat. No. 5,613,444.

[51] Int. Cl.[6] ..... B61F 5/00

[52] U.S. Cl. ..... 105/220; 105/221.1

[58] Field of Search ..... 105/182.1, 183, 105/196, 218.1, 220, 221.1, 225, 224.05, 224.06, 224.1

[56] References Cited

U.S. PATENT DOCUMENTS

| | | | |
|---|---|---|---|
| 2,047,248 | 7/1936 | Bachman | 105/221.1 |
| 3,110,269 | 11/1963 | Lusink et al. | 105/221.1 |
| 3,570,409 | 3/1971 | Oelkers | 105/221.1 |
| 4,091,739 | 5/1978 | Theurer et al. | 105/224.05 |

FOREIGN PATENT DOCUMENTS

| | | | |
|---|---|---|---|
| 2257480 | 8/1975 | France | 105/224.05 |
| 348979 | 11/1960 | Switzerland | 105/224.05 |
| 205163 | 6/1966 | Switzerland | 105/224.05 |
| 11732 of 1847 | | United Kingdom | 105/224.05 |

*Primary Examiner*—Mark T. Le
*Attorney, Agent, or Firm*—Jill M. Breedlove; Douglas E. Stoner

[57] ABSTRACT

A railway truck includes a frame having a pair of side frames and laterally extending transoms therebetween. A plurality of journal boxes are resiliently suspended from the side frames and support a pair of longitudinally spaced apart end axles extending laterally between the side frames. A pair of longitudinally spaced apart bellcranks are rotatably joined to each of the side frames between the end axles, with each bellcrank having a vertical crankshaft and a crank arm extending outwardly therefrom. A pair of traction links extend longitudinally along each of the side frames, with each link being pivotally joined between respective ones of the journal boxes and the crank arms for carrying tension and compression loads therebetween. A pair of adjoining reaction arms extend longitudinally along each of the side frames, with each reaction arm having a proximal end fixedly joined to a respective one of the crankshafts, and distal ends thereof adjoining each other. The reaction arm distal ends are joined together for carrying lateral reaction loads therebetween upon rotation of the crankshafts while permitting differential longitudinal and pivotal movement between the adjoining distal ends. Traction loads are carried in turn through the end axles, journal boxes, traction links, and bellcranks to the side frames. The end axles are self-steering in a yaw direction so that yaw of the first end axle corotates together corresponding ones of the bellcranks on opposite sides of the frame which in turn corotates together the reaction arms joined thereto which cantilever to counterrotate together the adjoining reaction arms to counterrotate the bellcranks joined thereto to counter-yaw the second end axle.

16 Claims, 24 Drawing Sheets

SELF-STEERING RAILWAY TRUCK

This application is a division, of application Ser. No. 08/743,060, filed Nov. 4, 1996 now U.S. Pat. No. 5,746,135 which is a division of application Ser. No. 08/555,569 (U.S. Pat. No. 5,613,444, filed Nov. 8, 1995 issued Mar. 25, 1997).

BACKGROUND OF THE INVENTION

The present invention relates generally to railway vehicles, and, more specifically, to self-steering trucks therein.

In a railway vehicle such as a locomotive, the vehicle body is mounted on a frame which in turn is mounted on a pair of longitudinally spaced apart multi-axle trucks having wheels which ride atop the rails of a train track. The two trucks are typically identical, with each truck having typically two or three axles and a pair of wheels on opposite ends thereof. Disposed outboard of the wheels on the ends of the axles are conventional self-contained bearings in housings which are typically supported in corresponding journal or bearing boxes suspended from the frame by suitable compression coil springs.

In an exemplary three axle diesel-electric locomotive, each axle further includes an integral electrical motor combination, or simply motor combo, for directly powering the wheels. The motor combos drive the wheels for propelling the locomotive either in forward or reverse directions utilizing inherent traction friction between the wheels and the rails. The locomotive, in turn, pulls or pushes a train of railway cars joined thereto. The trucks also include conventional brakes for stopping the locomotive again using the inherent traction friction between the wheels and the rails. Accordingly, traction loads must be carried between the axles and the frame during forward and reverse driving and braking operation. This is conventionally accomplished by suitably suspending the axles to the frame.

However, the axle suspensions must also accommodate vertical motion of the frame relative to the axles as well as limiting longitudinal and lateral translation movements therebetween and yaw rotation of the axles relative to the frame. By restricting the free motion of the axles relative to the frame, improved hunting stability is obtained. Hunting is a conventional term which refers to the uncontrolled lateral and yaw motion of the axles and the truck frame. Hunting often results in lower ride quality, with excess hunting even causing derailment of the locomotive.

Another consideration in locomotive design is the ability of the axles to negotiate curves during operation. In a multi-axle truck, the leading axle negotiates a turn before the trailing axle which creates substantial lateral loading between the axles and the frame and affects efficient operation and longevity of the trucks. In order to accommodate typical problems associated with negotiating rail curves, self steering trucks have been developed. Steering is accomplished by suitably interconnecting the leading and trailing axles so that the axles yaw in opposite directions to each other upon negotiating curves. However, typical train trucks have limited space available for introducing effective self-steering linkage, and conventional self-steering linkages have various degrees of complexity and efficiency in negotiating curves. Furthermore, by allowing the axles to yaw during operation for self-steering, the truck suspension must also allow increased lateral and longitudinal clearances between the axles and the truck frame for allowing a sufficient amount of yaw motion of the axles during curve negotiation. Since the axles are therefore able to move more freely, they are also more prone to undesirable hunting.

Axle suspension design is therefore complex since the axles must be vertically suspended from the frame for accommodating vertical loads; the axles must be longitudinally constrained for carrying the forward and reverse traction loads to the frame; the axles must be also mounted for allowing self-steering yaw motion thereof in opposite angular directions between leading and trailing axles; and, the axles must be laterally constrained. Axle suspension is made even more complex in a three-axle truck since the leading and trailing end axles must be interconnected angularly for self-steering, and the middle axle is independent therefrom and is interposed longitudinally therebetween. Conventional self-steering trucks therefore include a substantial number of pivoting joints which are typically made using conventional bearings or friction joints which are susceptible to wear and fretting problems.

Yet another significant problem in self-steering trucks is the requirement for effecting proper initial alignment between the various axles thereof in order to obtain effective performance during operation. Each axle and corresponding motor combo is a substantially heavy sub-assembly which is typically preassembled into its journal boxes and then assembled together to the truck frame with the corresponding compression springs therebetween. Alignment of the several axles is difficult to accomplish in view of the substantial weight of the sub-assembly which must be manually moved in relatively close proximity to adjacent components of the truck.

Accordingly, it is desirable to effect an improved self-steering multi-axle truck which more effectively utilizes available space for the various components thereof including the self-steering linkage with a reduced number of components thereof and with relatively few joints. Improved self-steering efficiency is also desired along with ease of initial alignment of the axles interconnected by the self-steering linkage.

SUMMARY OF THE INVENTION

A railway truck includes a frame having a pair of side frames and laterally extending transoms therebetween. A plurality of journal boxes are resiliently suspended from the side frames and support a pair of longitudinally spaced apart end axles extending laterally between the side frames. A pair of longitudinally spaced apart bellcranks are rotatably joined to each of the side frames between the end axles, with each bellcrank having a vertical crankshaft and a crank arm extending outwardly therefrom. A pair of traction links extend longitudinally along each of the side a frames, with each link being pivotally joined between respective ones of the journal boxes and the crank arms for carrying tension and compression loads therebetween. A pair of adjoining reaction arms extend longitudinally along each of the side frames, with each reaction arm having a proximal end fixedly joined to a respective one of the crankshafts, and distal ends thereof adjoining each other. The reaction arm distal ends are joined together for carrying lateral reaction loads therebetween upon rotation of the crankshafts while permitting differential longitudinal and pivotal movement between the adjoining distal ends. Traction loads are carried in turn through the end axles, journal boxes, traction links, and bellcranks to the side frames. The end axles are self-steering in a yaw direction so that yaw of the first end axle corotates together corresponding ones of the bellcranks on opposite sides of the frame which in turn corotates together the reaction arms joined thereto which cantilever to counterrotate together the adjoining reaction arms to counterrotate the bellcranks joined thereto to counter-yaw the second end axle.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
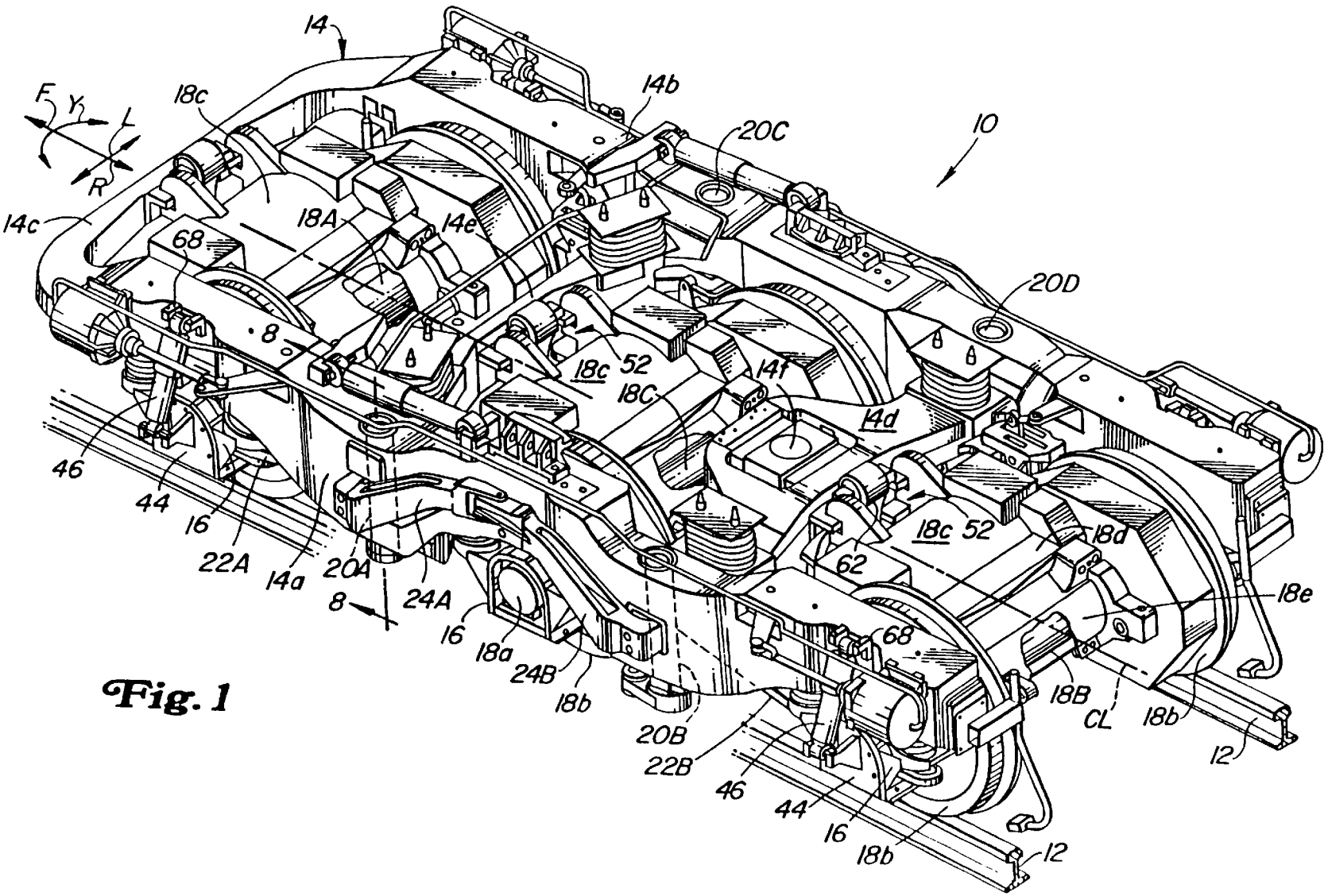
FIG. 1 is an isometric schematic view of an exemplary three-axle locomotive truck in accordance with one embodiment of the present invention including for example a self-steering linkage assembly mounted in the frame thereof.

Illustrated schematically in FIG. 1 is an exemplary railway truck 10 in accordance with an exemplary embodiment of the present invention. The truck 10 is one of two trucks which are configured for conventionally supporting a locomotive body (not shown) for powering a train of railway cars (also not shown). The truck 10 rides a pair of conventional rails 12 of a train track which includes various portions which are either straight or curved.

The trucks 10 are identical to each other and are typically mounted to the locomotive body in opposite orientations, with the following description of an exemplary truck 10 also applying to the other truck as well. The truck 10 includes a truck frame 14 having a longitudinal centerline axis CL. The frame 14 includes a pair of first and second laterally spaced apart and generally parallel side frames 14*a* and 14*b*, and three longitudinally spaced apart transoms 14*c*, 14*d* and 14*e* extending laterally between and integrally joined to the side frames 14*a,b*. The entire frame 14 is preferably made as a single casting, with the first transom 14*c* being joined to longitudinal ends of the side frames for closing the truck frame 14 at one end, the second transom 14*d* being spaced longitudinally inwardly from the opposite ends of the side frame for leaving open the opposite ends of the frame 14, and the third or middle transom 14*e* being spaced between the first and second transoms 14*c,d* in a substantially conventional configuration. However, the truck frame 14 itself preferably includes open C-sections as opposed to conventional closed box sections in accordance with another feature of the present invention as described later hereinbelow.

As indicated above, the truck 10 is one of two identical trucks which support the locomotive body, with the locomotive being used for driving a train of railway cars attached thereto. The considerable loads for driving the railway cars is conventionally carried through the truck frame 14 at a suitable trunnion 14*f* disposed in the center of the second transom 14*d*. A plurality of identical journal boxes 16 are resiliently suspended from the side frames 14*a,b* to in turn support a plurality of longitudinally spaced apart identical axles designated by the prefix 18 extending laterally between the side frames and having opposite ends rotatably mounted in respective ones of the journal boxes 16. In the exemplary embodiment illustrated in FIG. 1, the truck 10 is a three-axle truck with the three axles being identical to each other except for placement in the frame 14. The axles are therefore identified generally by the reference numeral 18 and specifically with a corresponding uppercase suffix, with first and second end axles 18A and 18B being disposed at longitudinally opposite ends of the frame 14 adjacent to the respective first and second transoms 14*c* and 14*d*, and the third or middle axle 18C being disposed longitudinally therebetween and adjacent to the third or middle transom 14*e* in a conventional configuration. However, the axles 18 are removably joined to the respective journal boxes 16 in accordance with another feature of the present invention also described in further detail later hereinbelow.

The axles 18 themselves are conventional, with each including an axle bearing assembly, or simply bearing 18*a* at both opposite ends of the axle which are captured in respective ones of the journal boxes 16. The axle bearing 18*a* is also conventional and typically includes a pair of tapered roller bearings for accommodating both radial and axial thrust loads, and which are mounted in a suitable annular bearing housing. Although modern trains typically use roller bearings instead of plain journal bearings, the bearing boxes which suspend the axles to the frame are typically still referred to as journal boxes.

Disposed immediately inboard of the end axle bearings 18*a* are respective wheels 18*b* which are also conventional for supporting the frame 14 on the rails 12. In the preferred embodiment illustrated in FIG. 1, the locomotive is a diesel-electric locomotive which conventionally provides power to conventional electrical motor 18*c* which are conventionally joined to respective ones of the axles 18 in a combination therewith typically called a motor combo. By suitably powering the motor combos 18*c*, the respective three axles 18 and wheels 18*b* thereon are powered for driving the truck 10 in either of two opposite longitudinal directions represented for example by a forward direction F and a reverse direction R relative to the centerline axis CL. The forward and reverse directions are relative and may be interchanged with each other if desired.

Self-Steering Truck Linkage

In accordance with one feature of the present invention, it is desired to provide self-steering of the end axles 18A,B to improve the ability of the truck 10 to negotiate curves with improved or relatively high hunting speed. As FIG. 1 clearly indicates, the truck 10 includes various components arranged closely together in a compact arrangement to provide relatively little space for self-steering linkage. Accordingly, an improved self-steering linkage assembly is provided having relatively few components and arranged in a relatively compact manner for providing effective self-steering between the end axles. The self-steering linkage includes various components which provide effective kinematic movements so that the end axles 18A,B yaw in opposite directions relative to each other when negotiating left or right curves on the rails 12. And, lateral translation between the several axles 18 is also preferably limited for also controlling the hunting speed. As shown in FIG. 1, the three axles 18 are disposed coplanar in a horizontal plane with lateral motion being designated by the double headed straight arrow L which represents side-to-side motion perpendicular to the frame centerline axis CL and the rails 12 in the horizontal plane, with yaw rotation being designated by the double headed curved arrow Y also in the same horizontal plane.

Furthermore, the self-steering linkage must also be effective for carrying the substantial traction loads between the wheels 18*b* and the truck frame 14 in an efficient manner without compromising the self-steering ability between the end axles 18A,B. The traction loads are created by powering the motors 18*c* to drive the axles 18 and wheels joined thereto in either the forward or reverse directions, with additional traction loads also being created in either direction upon application of conventional brakes found in the truck 10.

Figure 2:
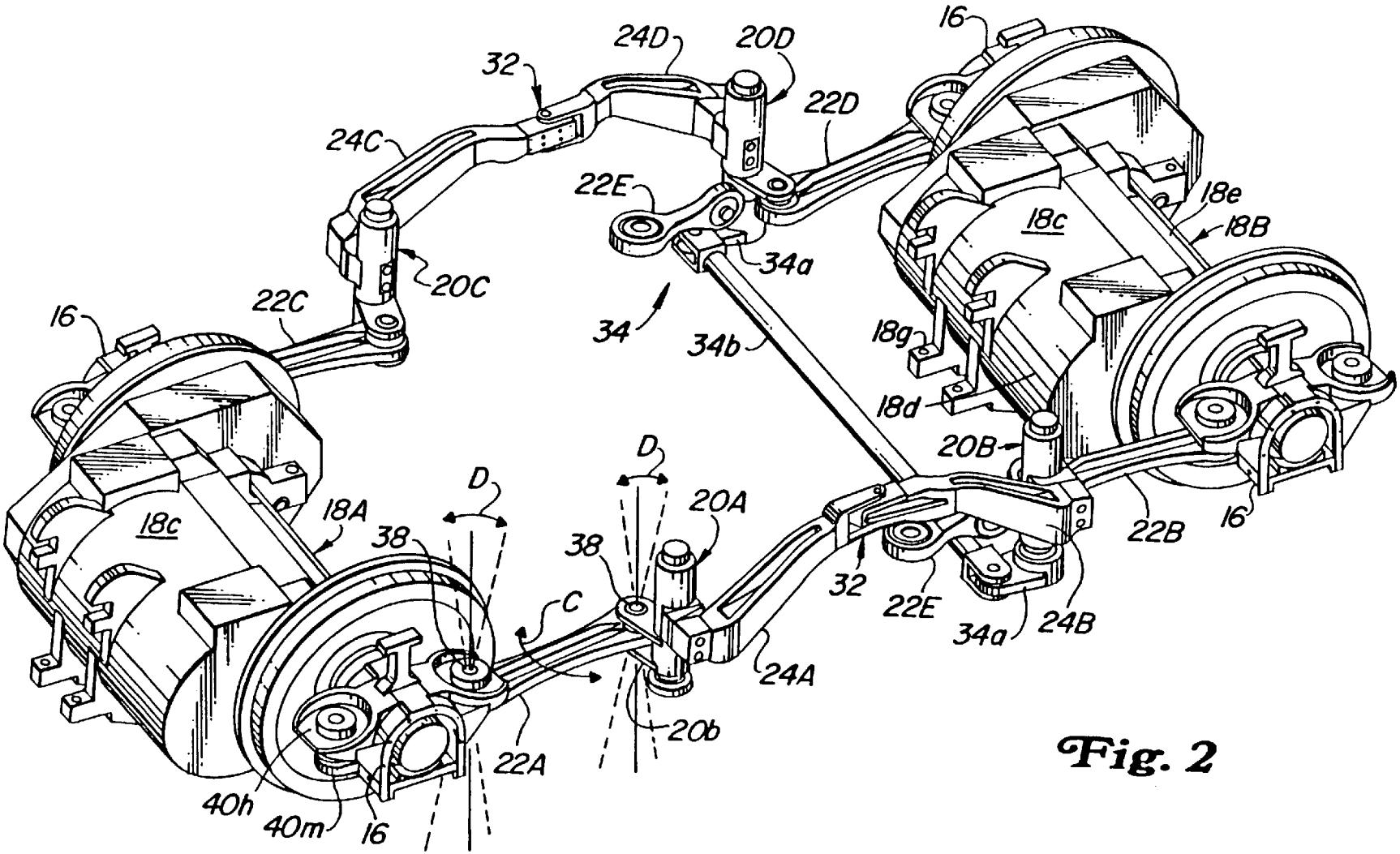
FIG. 2 is an isometric view of first and second end axles and the self-steering linkage assembly illustrated in FIG. 1 being removed from the frame thereof for clarity.
Figure 3:
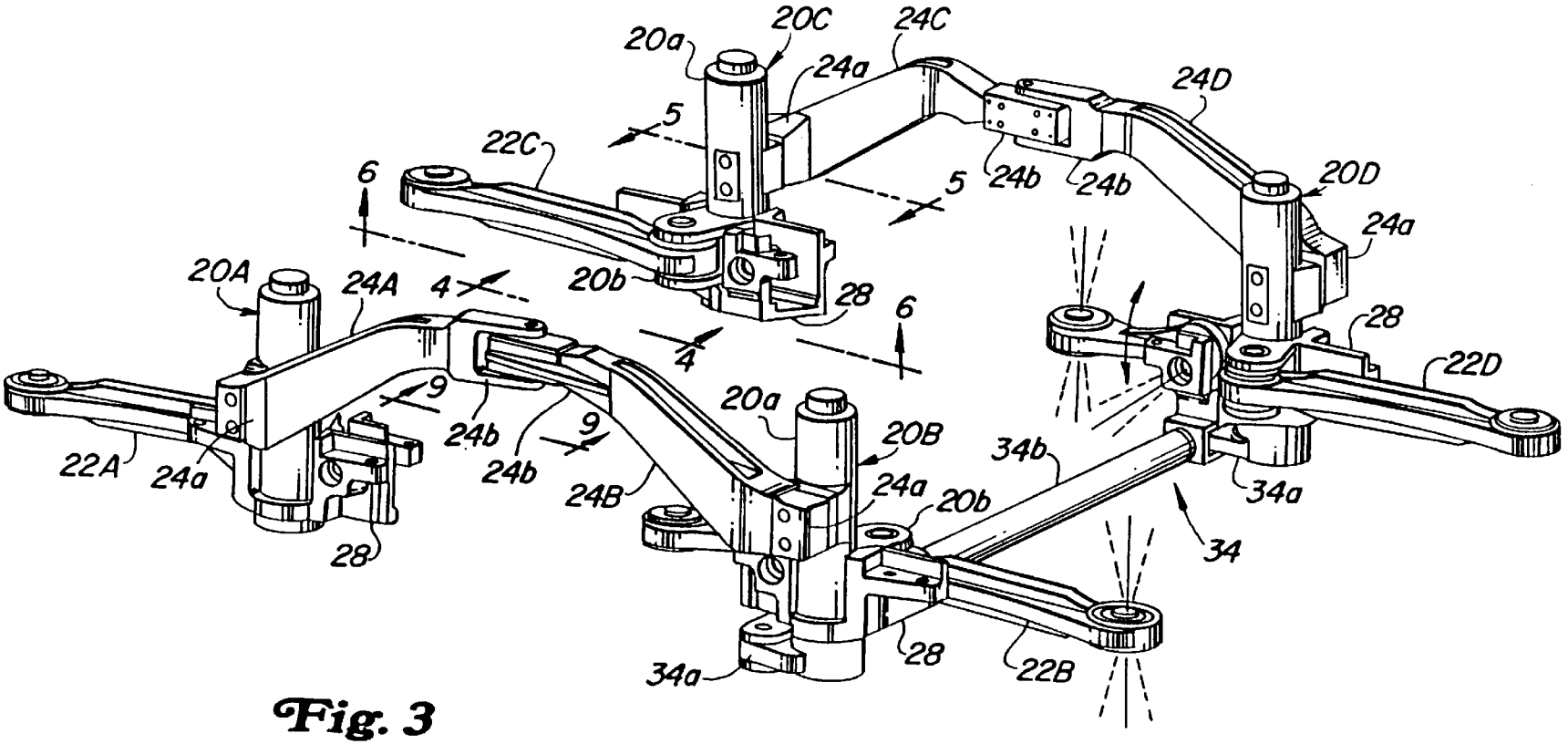
FIG. 3 is an isometric view of the self-steering linkage assembly illustrated in FIG. 2 removed from the two end axles therein, and including traction links, bellcranks, traction caps, and reaction arms operatively joined together.

The self-steering linkage in accordance with one embodiment of the present invention is illustrated in various levels of assembly in FIGS. 1–3. The middle axle 18C illustrated in FIG. 1 is not subject to self-steering, but makes it more difficult to provide self-steering in the truck 10. Although self-steering is being described with respect to a three-axle truck 10, it may also be applied to a simpler two-axle truck since only the end axles undergo self-steering and effect counter-yaw relative to each other when negotiating curves.

Figure 4:
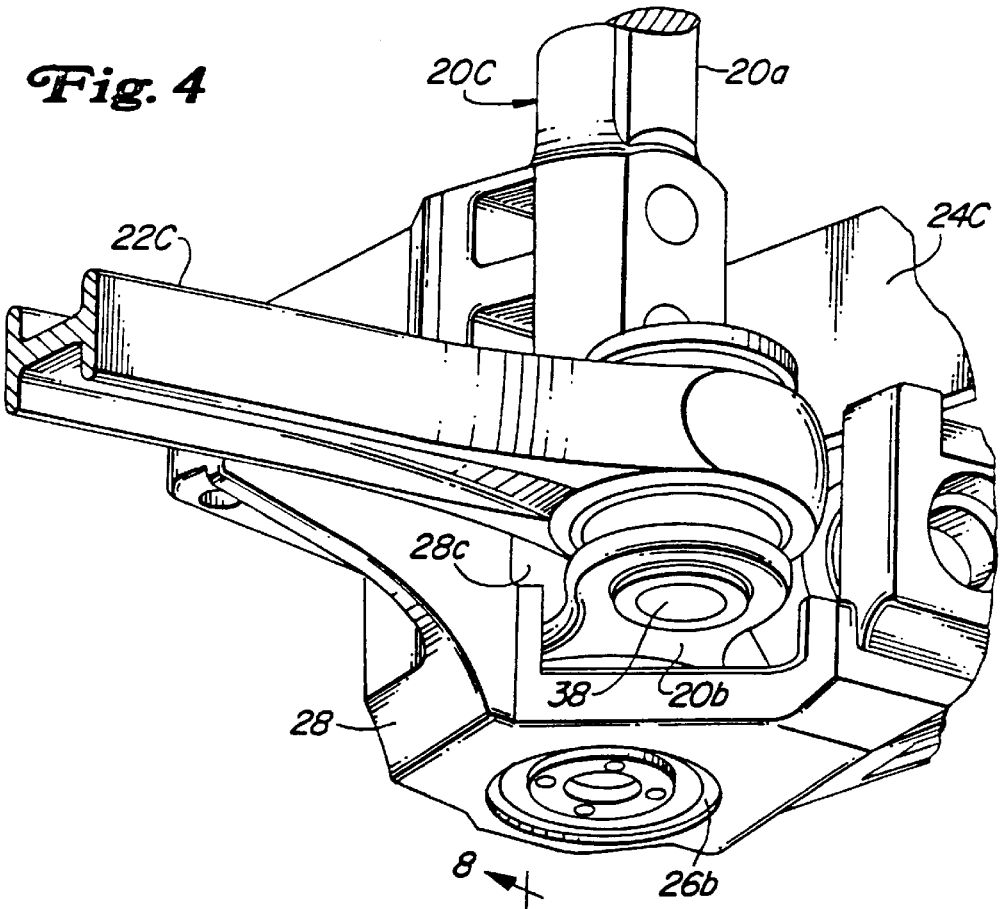
FIG. 4 is a fragmentary isometric view of a portion of an exemplary bellcrank, traction link, traction cap, and reaction arm of one of the assemblies thereof illustrated in FIG. 3 and viewed outboard in FIG. 3 generally along line 4—4.
Figure 5:
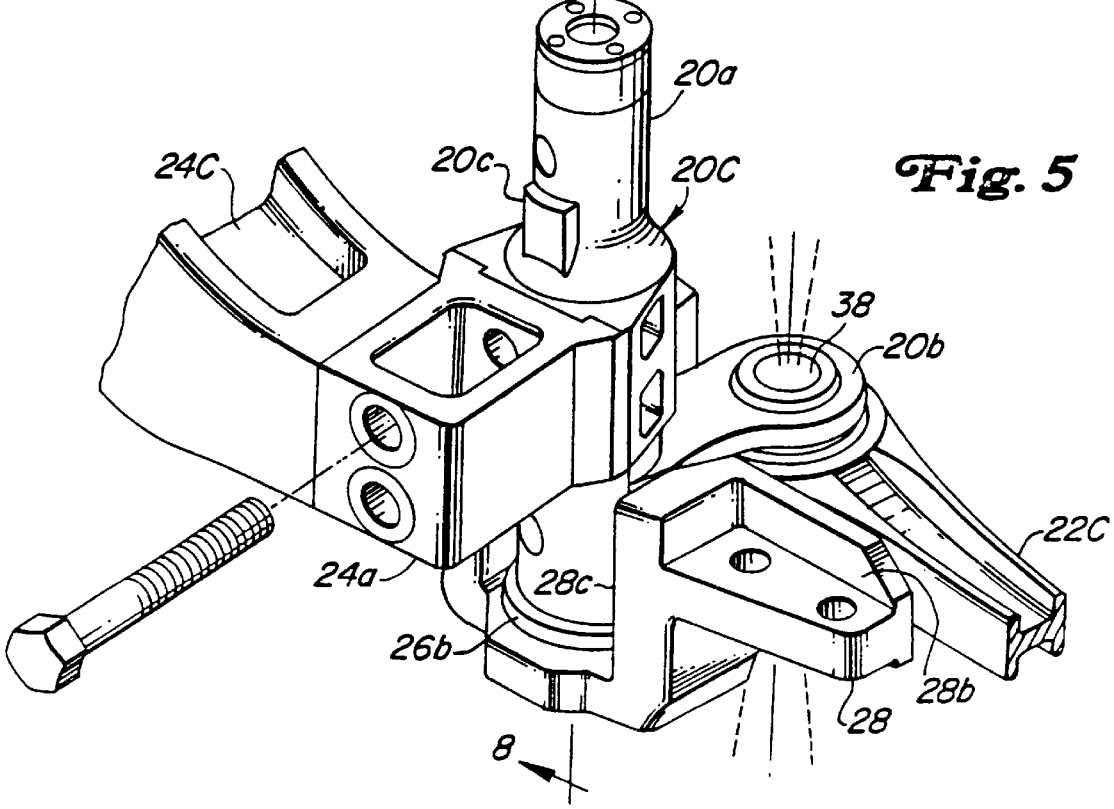
FIG. 5 is a fragmentary isometric view of the exemplary bellcrank, traction link, traction cap, and reaction arm of one of the assemblies thereof illustrated in FIG. 3 and viewed inboard in FIG. 3 generally along line 5—5.

Referring firstly to FIGS. 2 and 3, the self-steering linkage includes a pair of longitudinally spaced apart bellcranks which are basically identical to each other except for placement and orientation and are therefore referred to generally with the reference prefix numeral 20, followed by an uppercase suffix to identify individually located ones of the bellcranks 20. A first pair of first and second bellcranks 20A and 20B are rotatably joined to the first side frame 14*a* (as shown in FIG. 1) longitudinally between the end axles 18A,B and described in more detail hereinbelow. A second pair of third and fourth bellcranks 20C and 20D are rotatably joined to the second side frame 14*b* (as shown in FIG. 1) longitudinally between the end axles 18A,B and also described in more detail hereinbelow. Since each of the bellcranks 20 are substantially identical the various components thereof are identified using the same lowercase reference numeral suffix. FIGS. 4 and 5 illustrate in more particularity an exemplary one of the bellcranks 20, i.e. the third bellcrank 20C, with each bellcrank 20 having a vertically extending cylindrical main shaft or crankshaft 20*a*, and a traction crank arm 20*b* extending radially outwardly therefrom adjacent to a bottom end thereof.

Referring again to FIGS. 2 and 3, respective pairs of traction links designated generally by the prefix 22 extend longitudinally along each of the side frames 14*a,b* (see FIG. 1) for carrying the substantial tension and compression traction loads between the journal boxes 16 and the truck frame 14. Individual end traction links 22A–D are pivotally joined between respective ones of the end journal boxes 16 and the crank arms 20*b* for carrying tension and compression loads therebetween. As shown in FIG. 2, first, second, third, and fourth end traction links 22A, 22B, 22C, and 22D are respectively joined to the first, second, third, and fourth bellcranks 20A,B,C,D at the respective crank arms 20*b* thereof and to corresponding ones of the end journal boxes 16. The four end links 22A–D are preferably identical to each other.

Respective pairs of adjoining reaction arms designated generally by the prefix 24 extend longitudinally along each of the side frames 14*a,b* (see FIG. 1), with each reaction arm 24 being fixedly joined at one end to a respective one of the bellcranks 20, and overlapping each other in pairs at opposite ends thereof. As shown in FIGS. 2 and 3, first, second, third, and fourth reaction arm 24A, 246, 24C, and 24D are suitably fixedly joined to respective ones of the first, second, third and fourth bellcranks 20A–D at respective crankshafts 20*a* thereof.

As shown in FIG. 3 for example, each of the reaction arms 24 has longitudinally opposite proximal and distal ends 24*a* and 24*b*, with each proximal end 24*a* being suitably fixedly joined to a respective one of the crankshafts 20*a*, and the distal ends 24*b* adjoining each other in longitudinal overlap. The adjoining distal ends 24*b* of respective pairs of the reaction arms 24 are operatively joined together as described in more detail hereinbelow for carrying lateral reaction loads independently between each of the reaction arms pairs 24A,B and 24C,D at each side frame 14*a,b* upon rotation of the crankshafts 20*a* while permitting differential longitudinal and pivotal movement between the adjoining distal ends 24*b*.

Figure 6:
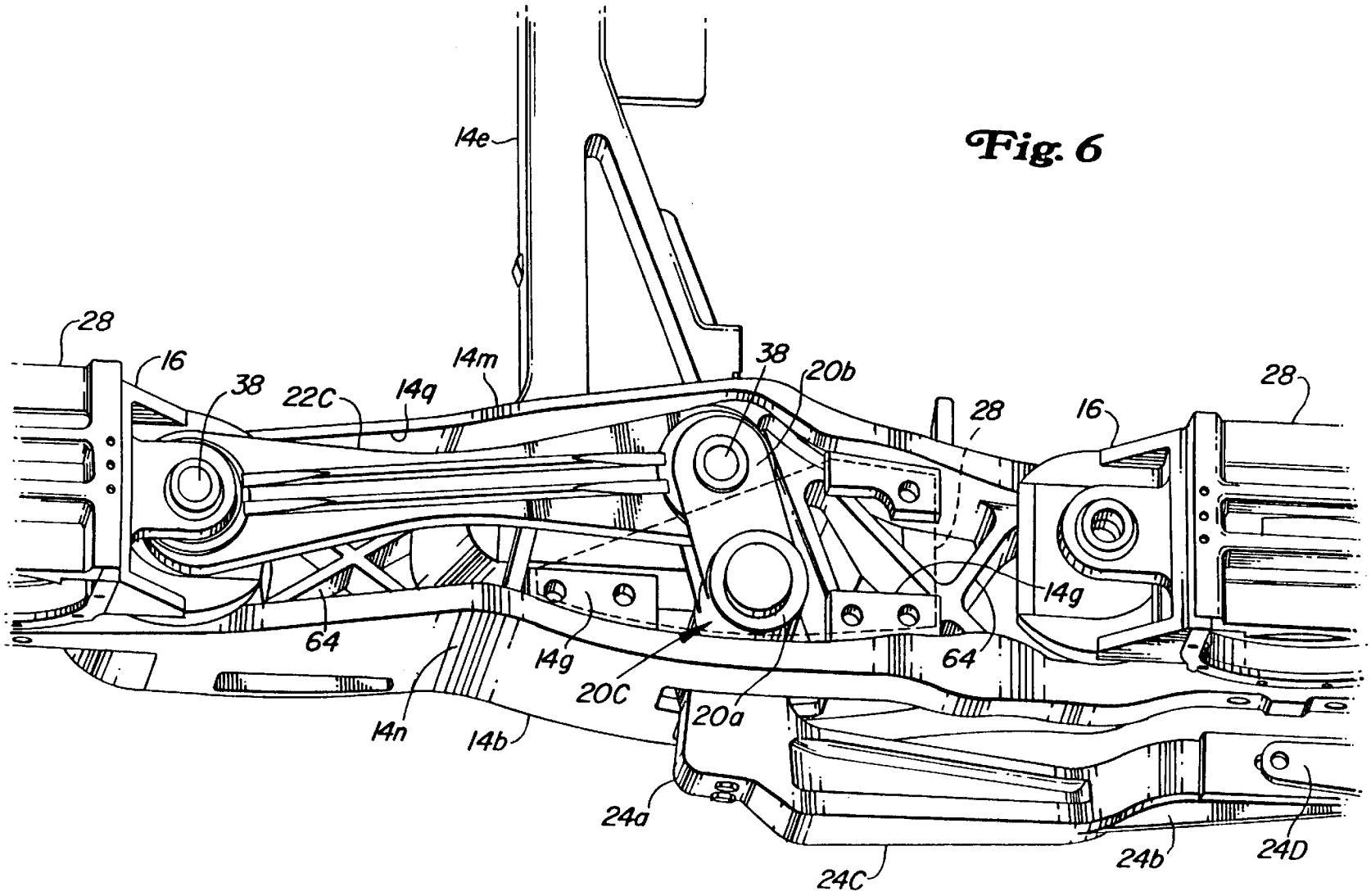
FIG. 6 is an upwardly facing view of the exemplary traction link, bellcrank, and reaction arm, without the traction cap, illustrated in FIG. 3 generally along line 6—6 installed in the corresponding side frame of the truck frame illustrated in FIG. 1.

FIG. 6 illustrates an exemplary one of the bellcranks 20 mounted inside its respective side frame 14*b* from below, with the corresponding third traction link 22C extending longitudinally therein to its respective journal box 16, and the corresponding third reaction arm 24C extending longitudinally in an opposite direction to adjoin the fourth reaction arm 24D. All four bellcranks, traction links, and reaction arms are similarly mounted in corresponding portions of the respective side frames 14*a,b*.

Figure 7:
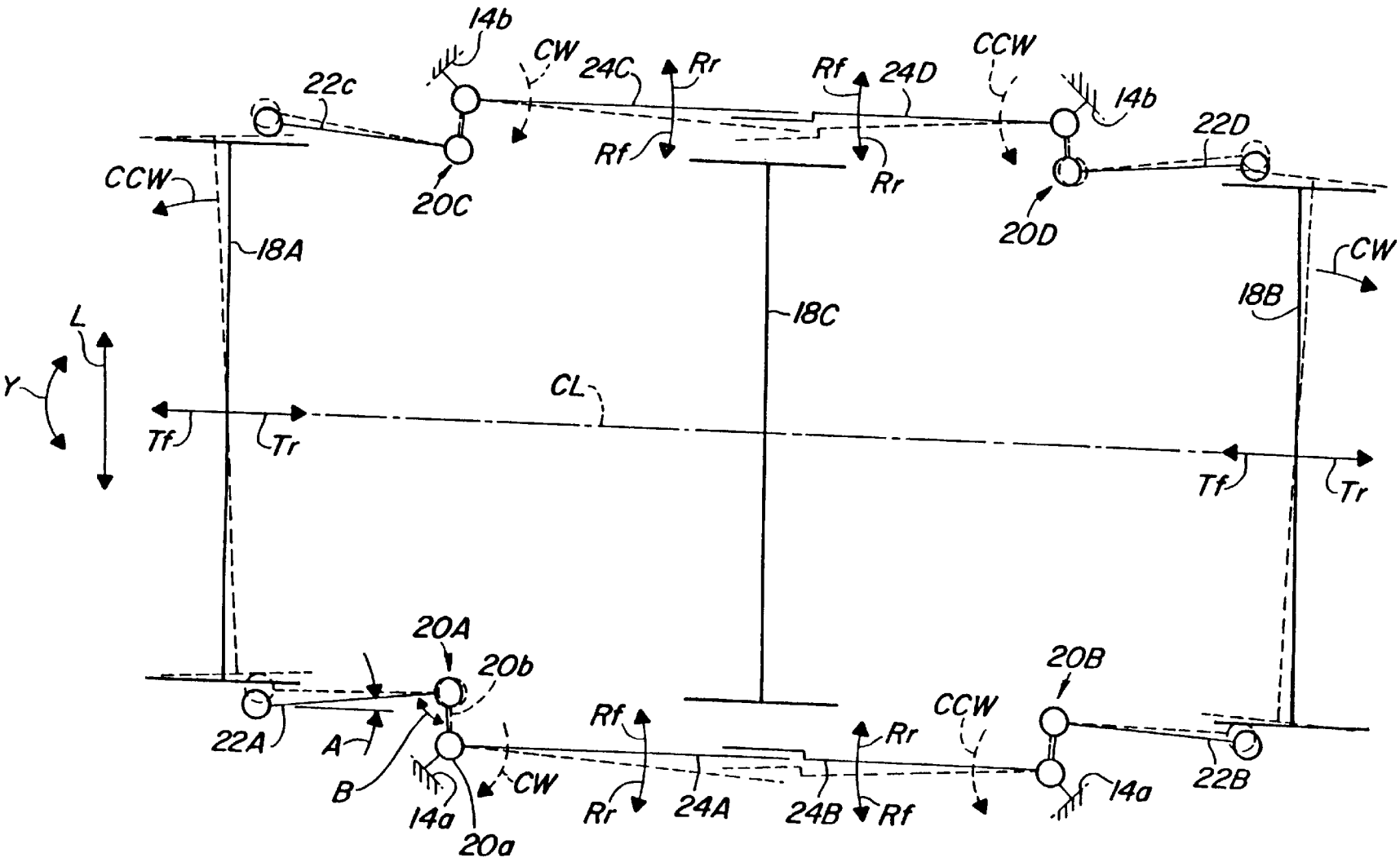
FIG. 7 is a schematic plan view of the truck frame illustrated in FIG. 1 showing the three axles and cooperating self-steering linkage in a nominal straight traveling configuration in solid line, and in dashed line negotiating a curve.

FIG. 7 illustrates schematically all four linkage subassemblies of corresponding bellcranks, traction links, and reaction arms mounted in the respective side frames 14*a,b* relative to the three axles 18A–C. FIG. 7 schematically represents operation of the self-steering linkage under straight forward and reverse traction loads designated Tf and Tr during drive or braking as shown in solid line, and during negotiation of a left curve for example, in dashed line, showing exaggerated relative displacements of the components. The forward and reverse traction loads are carried in turn through the end axles 18A,B, journal boxes 16 (not shown), traction links 22A–D, and the bellcranks 20A–D to respective side frames 14*a,b*. The bellcranks 20, traction links 22, and reaction arms 24 are symmetrically laterally disposed relative to the frame centerline axis CL, and symmetrically longitudinally disposed relative to the middle axis 18C.

The forward and reverse traction loads developed by the end axles 18A,B are carried directly into the side frames 14*a,b* through the respective bellcranks 20 joined thereto, with rotation of the bellcranks 20 being opposed or reacted by the cooperating adjoining reaction arms 24A,B and 24C,D. The forward traction force Tf at the first end axle 18A effects corresponding inboard directed reaction force Rf at the corresponding first and third reaction arms 24A,C joined thereto. The forward traction force Tf at the second end axle 18B effects outboard directed reaction force Rf on the corresponding second and fourth reaction arms 24B,D which opposes the inboard reaction forces from the adjoining first and third reaction arms 24A,C.

Under reverse traction loads Tr, corresponding oppositely directed reverse reaction loads Rr are effected at the adjoining pairs of reaction arms 24A,B and 24C,D. Accordingly, in one traction direction, e.g., forward traction Tf, the respective pairs of reaction arms are driven in opposite inboard and outboard directions toward each other, and in the opposite traction direction, e.g. the reverse traction force Tr, the adjoining reaction arms are similarly driven in opposite directions tending to separate apart the adjoining reaction arms. This symmetrical arrangement of the self-steering linkage ensures that the end axles 18A,B track straight relative to the frame centerline axis CL without yaw Y or lateral movement L. It also ensures that symmetric curving, i.e., same behavior in right-hand and left-hand curves, is obtained.

However, self-steering of the end axles 18A,B is efficiently effected as the truck negotiates either left or right curves, with the negotiating of a left curve being illustrated in dashed line in FIG. 7. As the first end axle 18A enters the left curve effected by the rails 12 shown in FIG. 1, the first axle 18A is permitted to undergo limited self-steering in the yaw direction Y, which is counterclockwise (CCW) in the example illustrated in FIG. 7. This yaw of the first axle 18A causes the corresponding ones of the bellcranks 20A,C on opposite sides of the frame to corotate together, e.g. clockwise (CW), which in turn corotates together the corresponding first and third reaction arms 24A,C joined thereto which cantilever to counterrotate together the adjoining second and fourth reaction arms 24B,D to counterrotate together the corresponding second and fourth bellcranks 20B,D joined thereto to counter-yaw the opposite second axle 18B in the clockwise direction.

Whereas the traction links 22 operate in simple tension and compression, the reaction arms 24 operate in simple lateral bending without significant longitudinal net tension or compression loading therein. The reaction arms 24 simply cantilever or rotate to pivot the respective bellcranks 20 for obtaining counter-yaw between the first and second axles 18A,B. In the left curve operation illustrated in dashed line in FIG. 7, both pairs of reaction arms 24 move to the left, with the first and second reaction arms 24A,B moving outboard, and the third and fourth reaction arms 24C,D moving inboard. For a right curve not illustrated in FIG. 7, the opposite movement occurs for yawing the first axle 18A in a clockwise direction, and counter-yawing the second axle 18B in the counterclockwise direction.

The non-symmetrical rotational movement of the adjoining reaction arm pairs shown in dashed line in FIG. 7 during self-steering illustrates the multi-functional joint required between the distal ends thereof. Since each reaction arm 24 must rotate during self-steering operation, both differential longitudinal and pivotal movement between the adjoining distal ends is required. And, the joint must also effectively carry the required lateral reaction forces Rf and Rr between the adjoining reaction arm distal ends which are laterally driven together or apart as described in more detail later hereinbelow.

However, specific details of the various components of the self-steering linkage will be addressed first. A significant function of the truck axle suspension is to carry the substantial traction loads from the axles 18 to the frame 14 shown in FIG. 1 for driving and braking the locomotive and train. Accordingly, the traction links 22 are suitably sized to carry respective portions of the traction loads therethrough in either tension or compression, which traction loads must be effectively transferred to the truck frame 14. This is accomplished by using the four bellcranks 20A–D suitably rotatably mounted in the respective side frames 14*a,b*. Since the several bellcranks 20 are identically mounted to the truck frame 14, FIGS. 3–6 and 8 are used for example for illustrating the preferred assembly thereof in accordance with one embodiment of the present invention.

Figure 8:
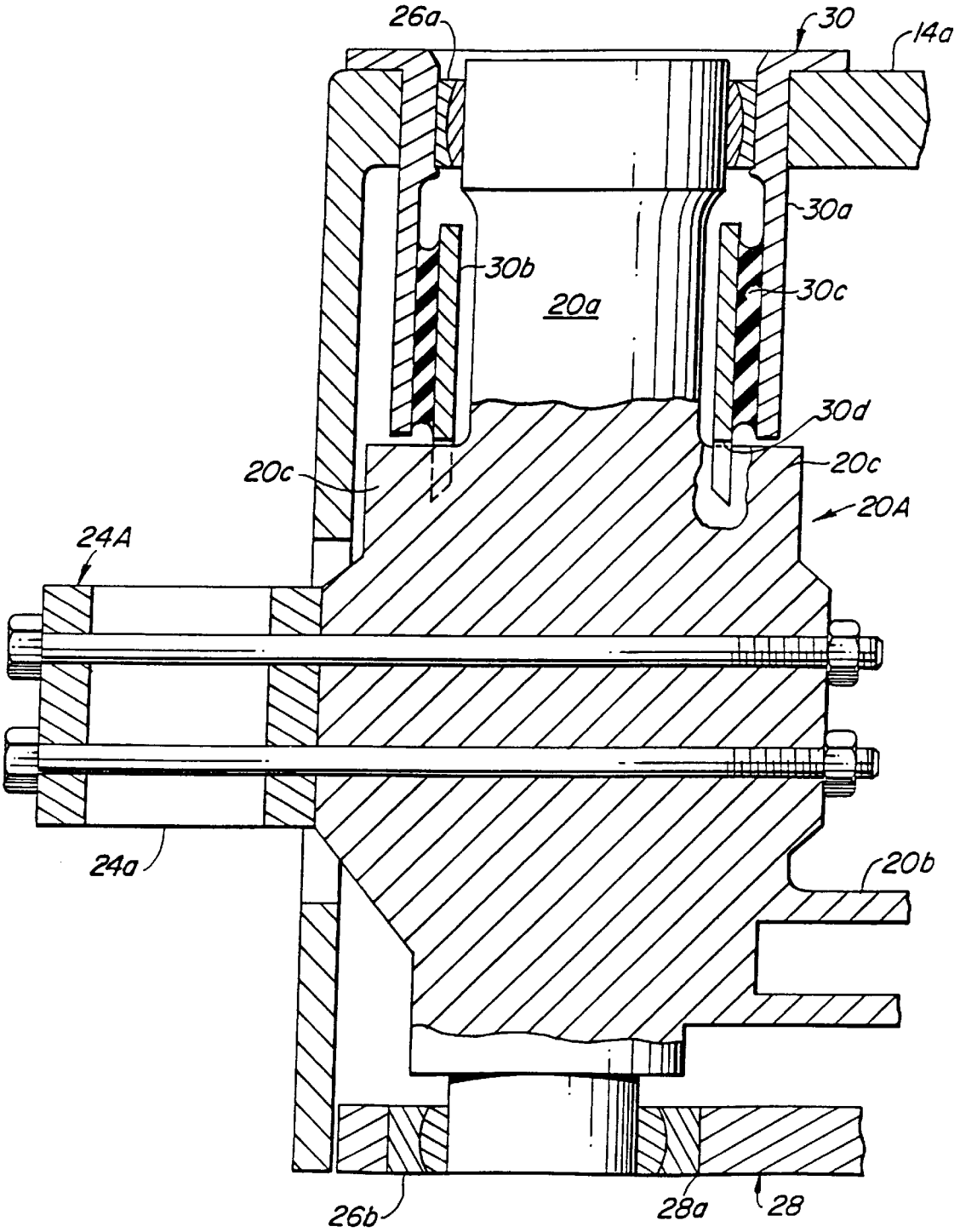
FIG. 8 is a partly sectional, elevational view through the exemplary bellcrank and traction cap illustrated in FIG. 5 taken along line 8—8 as installed in the side frame illustrated in FIG. 1 also taken along line 8—8.

As illustrated initially in FIG. 8, each of the crankshafts 20*a* is vertically disposed and has top and bottom ends, with conventional top and bottom spherical bearings 26*a* and 26*b* being suitably mounted thereto for supporting the crankshaft 20*a* to the side frames 14*a,b* of the truck frame. The bearings 26 are fixedly joined to the side frames 14*a,b* for carrying the respective portions of the traction loads thereto while allowing rotation of the crankshaft 20*a* for effecting self-steering. In the preferred embodiment illustrated in FIGS. 3–6 and 8, the crank arms 20*b* are preferably disposed near the bottom of the respective crankshafts 20*a*, and a removable support frame or traction cap 28 is provided for each of the bellcranks 20 for removably joining the individual bellcranks 20 to the side frames 14*a,b* and for carrying the substantial portion of the traction loads from the respective traction links 22 into the side frames 14*a,b*.

The traction caps 28 are preferably identical to each other except as noted below, with each including a bore 28*a* as illustrated in FIG. 8 for removably mounting the bottom end of the crankshaft 20*a* and the corresponding bottom bearing 26*b*. The bottom bearing 26*b* may be suitably press fit into the bore 28*a*, with the bottom bearing 26*b* being installed over the bottom end of the crankshaft 20*a* in a suitably close sliding fit during assembly. The traction cap 28 is shown installed on the respective crankshafts 20*a* in FIGS. 3–5 and 8, and removed from the crankshaft 20*a* as illustrated in FIG. 6 for clarity of presentation, but illustrated in dashed line in its installed position. The traction cap 28 is suitably configured to support the bottom end of the crankshaft 20*a* in the confined space available in the side frames 14*a,b*. Each traction cap 28 further includes a plurality of lugs 28*b* one of which is illustrated in FIG. 5 as having machined surfaces in the form of an L-shaped recess which mates with a plurality of complementary frame lugs 14*g* formed integrally in the respective side frames 14*a,b* as shown in FIG. 6. In the exemplary embodiment of the traction cap 28, there are three cap lugs 28*b* spaced apart in a generally triangular configuration for mating with three complementary frame lugs 14*g* as illustrated in FIG. 6, with abutting contact between the mating lugs 28*b* and 14*g* being effective for carrying the substantial traction loads into the side frames 14*a,b*. Each of the lugs 28*b* and 14*g* has corresponding apertures therethrough which receive suitable fasteners or bolts for removably joining the traction caps 28 to the side frames 14*a,b*. The cap lugs 28*b* therefore carry the traction loads to the side frames 14*a,b*, with the traction cap mounting bolts being used solely for that purpose and do not carry the traction loads.

As shown in FIGS. 4 and 5, each of the traction caps 28 further includes a generally vertically U-shaped cavity 28*c* which receives the respective crank arm 20*b* above the bottom bearings 26*b*. The cap cavities 28*c* are preferably sized for allowing limited rotation of the crank arms 20*b* during operation, with the traction loads being carried through the body of the traction caps 28 themselves. If desired, the cap cavities 28*c* may be suitably sized for limiting rotational movement of the crank arms 20*b* within predetermined limits upon abutting contact with adjacent sides of the cavity 28*c*. However, the steering linkage movements are preferably limited by limiting travel of the journal boxes as described later hereinbelow.

Referring to FIG. 8, the top of the crankshaft 20*a* may be directly joined to the side frames 14*a,b* using the corresponding top bearing 26*a* suitably press fit therein. However, in the preferred embodiment illustrated in FIG. 8, a resilient yaw stiffener 30 is joined between the side t-s frame 14*a,b* and the respective top ends of all of the crankshafts 20*a* for mounting the top bearing 26*a* and for providing suitable countertorque against rotation of the crankshafts 20*a* during operation for improving hunting speed. The yaw stiffener 30 is described in further detail later hereinbelow.

As shown in FIGS. 5, 6, and 8, each of the reaction arm proximal ends 24*a* is preferably removably joined to the corresponding crankshaft 20*a* at a suitable rabbet joint for suitably carrying reaction loads therebetween, while allowing assembly and disassembly thereof. As shown in FIGS. 6 and 8, the bellcranks 20 are preferably disposed inside the side frames 14*a,b*, with a suitable lateral opening being formed in the side frames through which extends the reaction arm proximal end 24*a* for being joined to the crankshaft 20*a*. During the assembly process, each crankshaft 20*a* without its mating reaction arm 24 may be inserted into its mounting cavity in the side frames 14*a,b*, followed in turn by assembling the individual reaction arms 24 to the crankshafts 20*a* through the side openings. As shown in FIG. 8, the reaction arms are joined to the crankshafts 20*a* by a pair of suitable through-bolts extending therethrough. The individual bellcranks 20 are therefore preferably disposed in most part inside the side frames 14*a,b*, with the reaction arms 24 being disposed in most part outside the side frames 14*a,b*. Upon installation of the traction caps 28 over the bottom ends of the crankshafts 20*a* as shown in dashed line in FIG. 6, the bellcranks 20 are substantially enclosed within the side frames 14*a,b* in an efficient and compact arrangement. Similarly, the traction links 22 are also disposed in most part inside the side frames 14*a,b* as shown in FIGS. 1 and 6 for example.

As indicated above with respect to FIG. 3 for example, suitable means must be provided for operatively joining together first and second the adjoining pairs of reaction arms 24A,B and 24C,D for accommodating differential movement therebetween during operation and for effectively carrying the lateral reaction forces Rf and Rr. The reaction arms are illustrated in more particularity in FIGS. 9–11 wherein the first and second adjoining reaction arms 24A,B are illustrated for example, with the third and fourth traction arms 24C,D being configured identically. As indicated above with respect to FIG. 7, and now referring to FIG. 9, the adjoining distal ends 24*b* of the reaction arms 24 must effectively carry the lateral reaction forces Rf and Rr therebetween which tend to bring together or separate the distal ends during operation. And, as the reaction arms 24 rotate inboard or outboard together during self-steering operation, the respective distal ends 24*b* thereof must accommodate differential longitudinal movement therebetween Dl and differential pivotal movement therebetween Dp.

Figure 9:
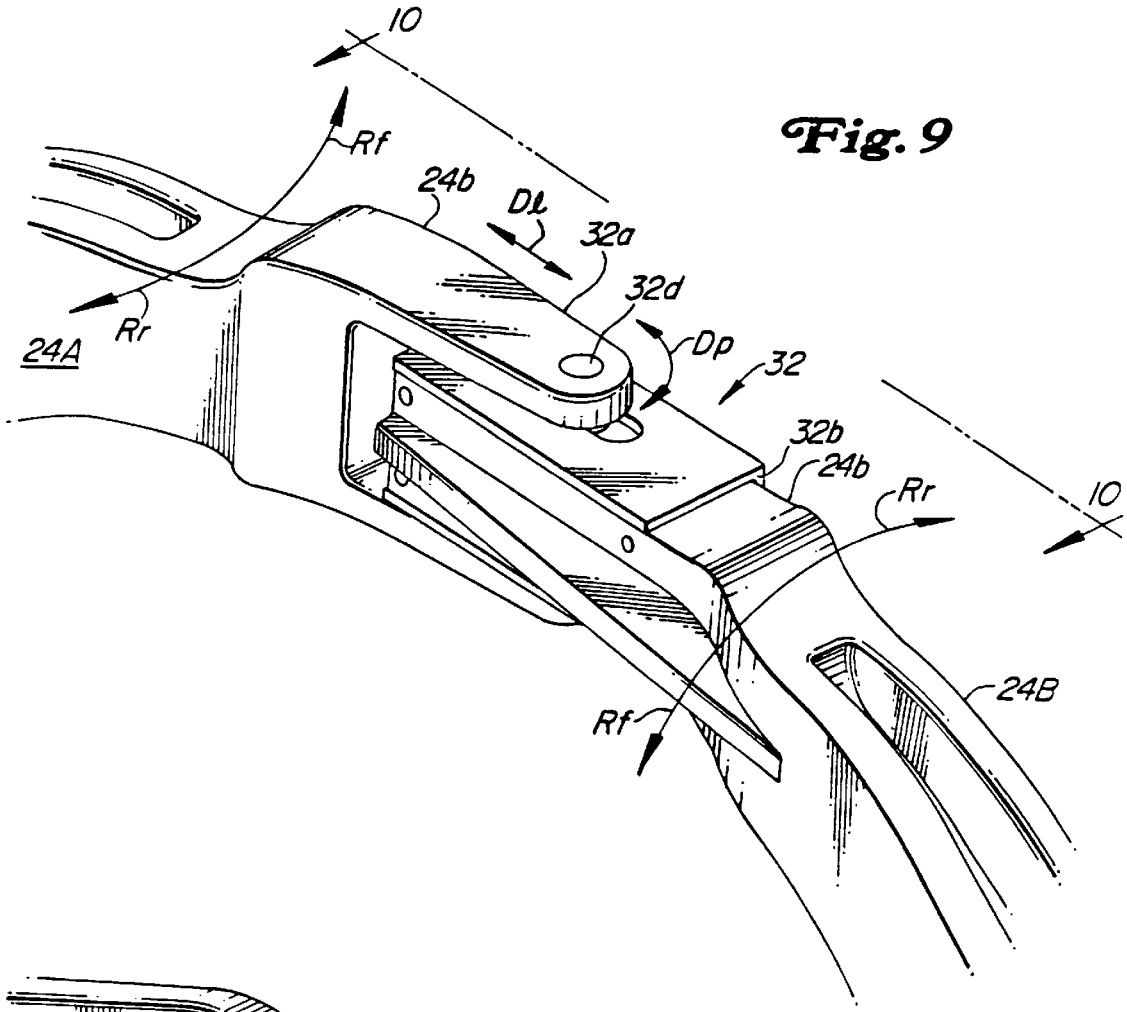
FIG. 9 is an isometric inboard view of a portion of adjoining reaction arms illustrated in FIG. 3 and taken along line 9—9.
Figure 10:
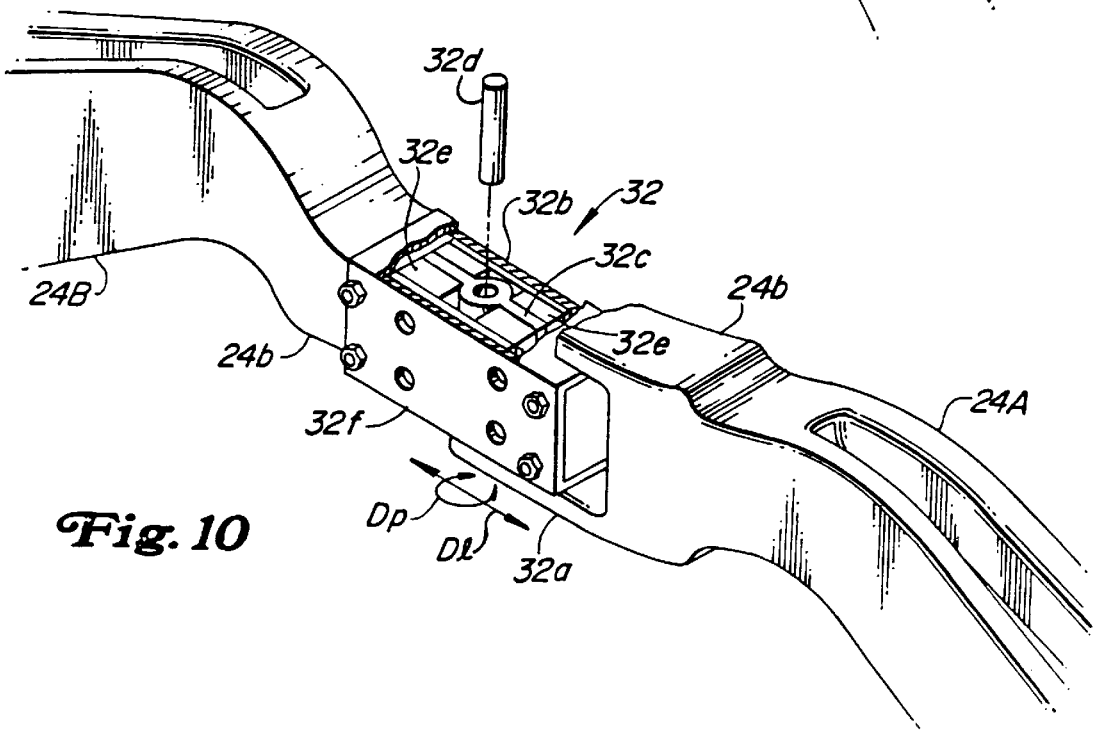
FIG. 10 is an isometric of the adjoining reaction arms illustrated in FIG. 9 taken outboard along line 10—10.
Figure 11:
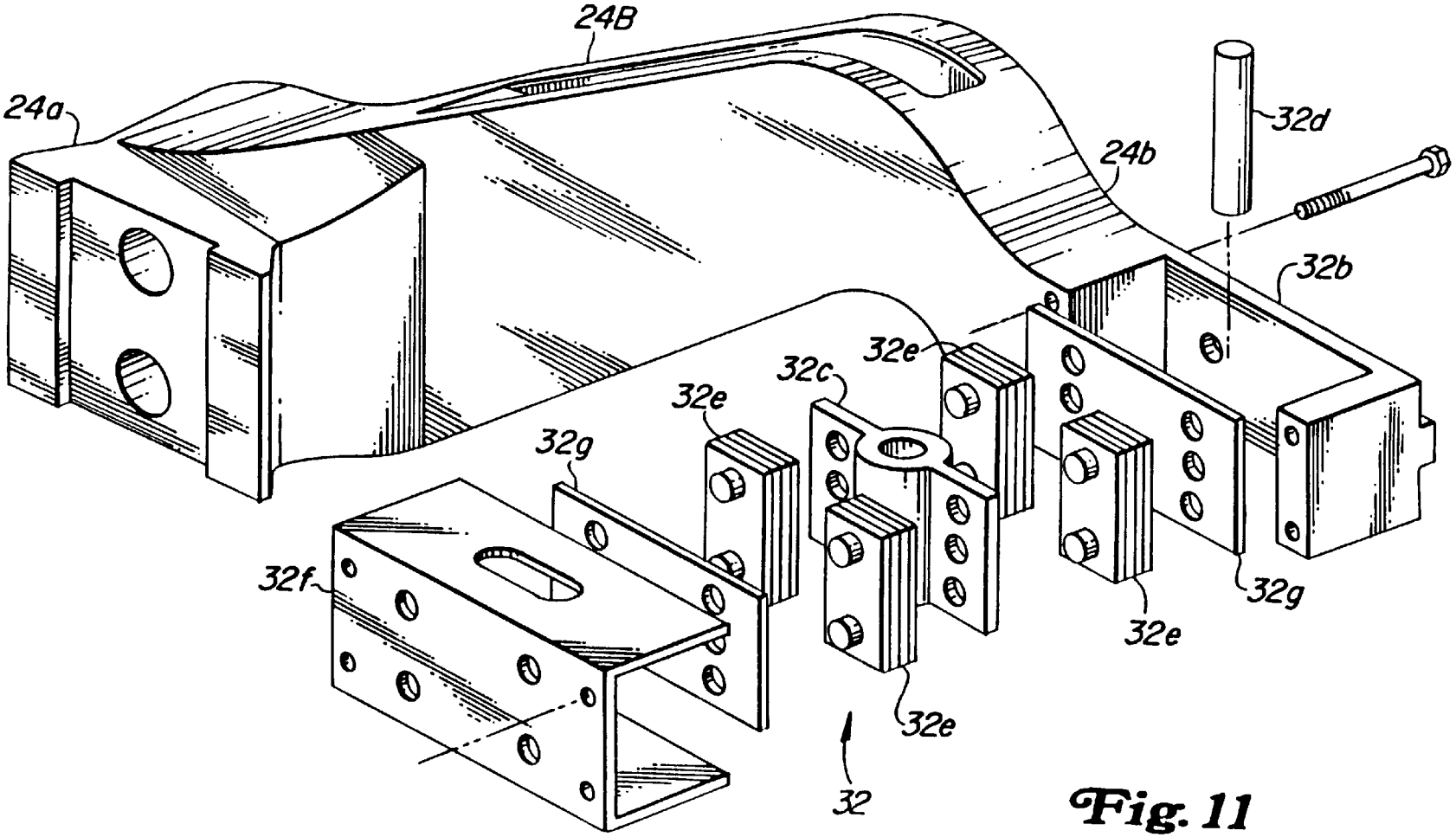
FIG. 11 is an isometric exploded view of one of the reaction arms illustrated in FIG. 10 including an elastomeric wing plate clamped to a distal end thereof.

Accordingly, suitable joining means 32 as illustrated in FIGS. 9–11 are provided for suitably joining the adjoining distal ends 24*b* of the reaction arms 24 for accomplishing these many objectives. The joining means 32 in an exemplary embodiment includes a generally U-shaped fork 32*a* formed integrally with the distal end 24*b* of one reaction arm and a generally U-shaped housing or bracket 32*b* formed integrally with the distal end 24*b* of the adjoining reaction arm 24. The open end of the fork 32*a* faces longitudinally for receiving the bracket 32*b* therein, with the open end of the bracket 32*b* extending laterally inboard for example. A metal wing plate 32*c* as shown in FIGS. 10 and 11 has an enlarged center hub with a bore therethrough for receiving a vertically extending reaction pin 32*d* which extends through corresponding mounting holes in the ends of the two legs forming the fork 32*a* for fixedly mounting the wing plate 32*c* to the fork 32*a* while allowing the wing plate 32*c* to rotate relative to the fork 32*a* at the distal end 24*b* of the reaction arm.

A plurality of elastomeric shear pads 32*e* are suitably fixedly joined to opposite lateral sides of the wing plate 32*c* as shown assembled in FIG. 10 and exploded in FIG. 11. A generally Ushaped clamping plate 32*f* is suitably fixedly joined to the bracket 32*b* by a plurality of fastener bolts for example for clamping and compressing the shear pads 32*e* and wing plate 32*c* therebetween against the housing 32*b* of the adjoining reaction arm distal end 24*b* for allowing the wing plate 32*c* to translate relative to the bracket 32*b* upon shearing of the pads 32*e* in the longitudinal direction generally parallel with the frame centerline axis.

As shown in FIG. 10 for example, since the reaction pin 32*d* is fixedly mounted to the fork 32*a* its longitudinal movement is constrained therewith while allowing differential pivotal movement Dp. The clamping plate 32*f* clamps the wing plate 32*c* against the bracket 32*b* in a sandwich arrangement by compressing the shear pads 32*e* on opposite sides thereof. Differential longitudinal movement Dl between the fork 32*a* and the bracket 32*b* is provided within a suitable useful range by shearing of the elastomeric pads 32*e* upon relative longitudinal movement between the wing plate 32*c* and the bracket 32*b*. As the adjoining reaction arms 24A,B move inboard or outboard together, the corresponding differential pivotal movement Dp therebetween is accommodated by rotation of the wing plate 32*c* relative to the fork 32*a*, and the differential longitudinal movement Dl is accommodated by shearing movement of the shear pads 32*e*. In this way, the required differential movement between the distal ends 24*b* of the adjoining reaction arms 24A,B and 24C,D is effected for allowing self-steering operation of the linkage. Since the shear pads 32*e* are resiliently distorted during differential longitudinal movement between the distal ends of the reaction arms 24, an inherent resilient restoring force is created for improving the hunting speed of the truck.

Since the joining means 32 must suitably carry the lateral reaction loads Rf, Rr between the adjoining reaction arms, it is desirable that the shear pads 32*e* be substantially stiff in compression for minimizing differential lateral movement between the adjoining reaction arms for obtaining substantially equal but opposite yaw of the end axles 18A,B. In the preferred embodiment illustrated in FIGS. 10 and 11, each of the shear pads 32*e* comprises a plurality of alternating layers of metal and elastomer bonded together for increasing compressive stiffness thereof while permitting resilient shearing movements therebetween. The shear pads 32*e* may therefore be substantially stiff in compression for minimizing differential lateral movement between the fork 32*a* and bracket 32*b* for improving hunting speed, but are sufficiently resilient or flexible in shear for allowing the differential longitudinal and pivotal movements Dl, Dp required.

As shown in FIG. 11, the wing plate 32*c* may have a plurality of lateral through holes therein for engaging metallic knubs formed on the adjoining metallic layer of the shear pads 32*e*. The alternating metallic and elastomeric layers of the shear pads 32*e* are suitably fixedly bonded together, with the knubs ensuring effective transfer of the shear loads between the wing plate 32*c* and the shear pads 32*e*. The opposite faces of the shear pads 32*e* may also include similar knubs which engage cooperating holes in the bracket 32*b* and the clamping plate 32*f* for effectively transferring the shear loads from the pads 32*e* to the reaction arms.

In the preferred embodiment illustrated in FIGS. 10 and 11, the joining means 32 further include at least one or more shim plates 32*g* disposed in abutting contact with the shear pads 32*e* on one or both sides of the wing plates 32*c* as required for use in aligning the bore of the wing plate 32*c* with the reaction pin 32*d* joined to the fork 32*a* during assembly. As described in more detail later hereinbelow, the end axles 18A,B may be aligned during assembly by laterally moving the individual reaction arms 24. Upon axle alignment, the mounting holes for the reaction pin 32*d* in the fork 32*a* may not necessarily align with the center bore of the wing plate 32*c* when it is clamped into the bracket 32*b*. By providing the shim plates 32*g* on either or both sides of the wing plate 32*c*, the position of the center bore thereof may be laterally adjusted so that the reaction pin 32*d* may be readily aligned therewith to complete the assembly process. As shown in FIG. 11, the top, as well as the bottom, leg of the clamping plate 32*f* has a suitably large aperture through which the reaction pin 32*d* may extend with suitable lateral clearance for accommodating the preferred range of shim adjustments. The apertures in the legs also extend over a suitable longitudinal range for accommodating expected longitudinal differential movement Dl between the adjoining reaction arms. The shim plates 32*g* preferably include holes therein through which the knubs of the shear pads 32*e* may extend into the adjacent bracket 32*b* and clamping plate 32*f*.

Referring again to FIG. 7, the traction links 22 adjoining each of the end axles 18A,B on opposite sides of the truck frame 14 are preferably symmetrically oppositely inclined to each other relative to the frame centerline axis CL and are therefore non-parallel to each other in this horizontal plane to preferably couple lateral translation L of the end axles 18A,B to yaw rotation Y thereof. In an alternate embodiment, the traction links 22 may be disposed longitudinally parallel with the frame centerline axis CL which would uncouple lateral translation of the end axles from yaw rotation thereof. Coupling, however, is desired so that as the truck enters a curve, laterally inwardly directed forces relative to the radius of the curve initiate operation of the self-steering linkage to yaw the first axle 18A in one direction and effect counter-yaw of the second axle 18B for improving operation and hunting stability. In the preferred embodiment illustrated in FIG. 7, each of the traction links 22 is inclined at the same acute angle A relative to the frame centerline axis CL, and the corresponding crank arms 20*b* are disposed substantially perpendicularly to the respective traction links 22 joined thereto at an angle B of about 90°. The inclination angle A is preferably about 6° for providing effective coupling between lateral and yaw movement of the end axles, and may otherwise be in the range of about 0–45°.

Also in the preferred embodiment illustrated in FIG. 7, the crank arms 20*b* preferably extend inboard toward the frame centerline axis CL from respective ones of the crankshafts 20*a*, with the traction links 22 correspondingly being inclined inboard toward the respective distal ends of the crank arms 20*b*. In this configuration, the first and third bellcranks 20A,C adjacent to the first end axle 18A counterrotate against the yaw direction of the first end axle 18A, e.g., clockwise versus counterclockwise as illustrated in dashed line. And, the second and fourth bellcranks 206,D adjacent to the second end axle 18B counterrotate against the counter-yaw direction of the second axle 18B, e.g. counterclockwise rotation versus clockwise rotation as shown in dashed line.

As shown in FIG. 2 for example, the four end traction links 22A–D are preferably substantially coplanar in the same horizontal plane with the centers of the first and second end axles 18A,B for obtaining effective kinematic and traction load carrying capability therebetween. The four reaction arms 24A–D are aligned generally longitudinally with the respective traction links 22 on each side of the truck frame 14 and rotate laterally in a common horizontal plane parallel with the plane of the traction links 22. Since the middle axle 18C as shown in FIG. 1 is also in the same plane as the end axles 18A,B, the reaction arms 24 are preferably curved upwardly to provide suitable clearance around the middle journal boxes 16 supporting the middle axle 18C. The reaction arms 24 also preferably hug relatively closely to the outboard sides of the respective side frames 14*a,b* for providing a compact arrangement therewith. And, since the bellcranks 20 and traction links 22 are preferably disposed in most part inside the side frames 14*a,b*, most of the self-steering linkage is substantially hidden in space not typically available in conventional truck frames.

Figure 12:
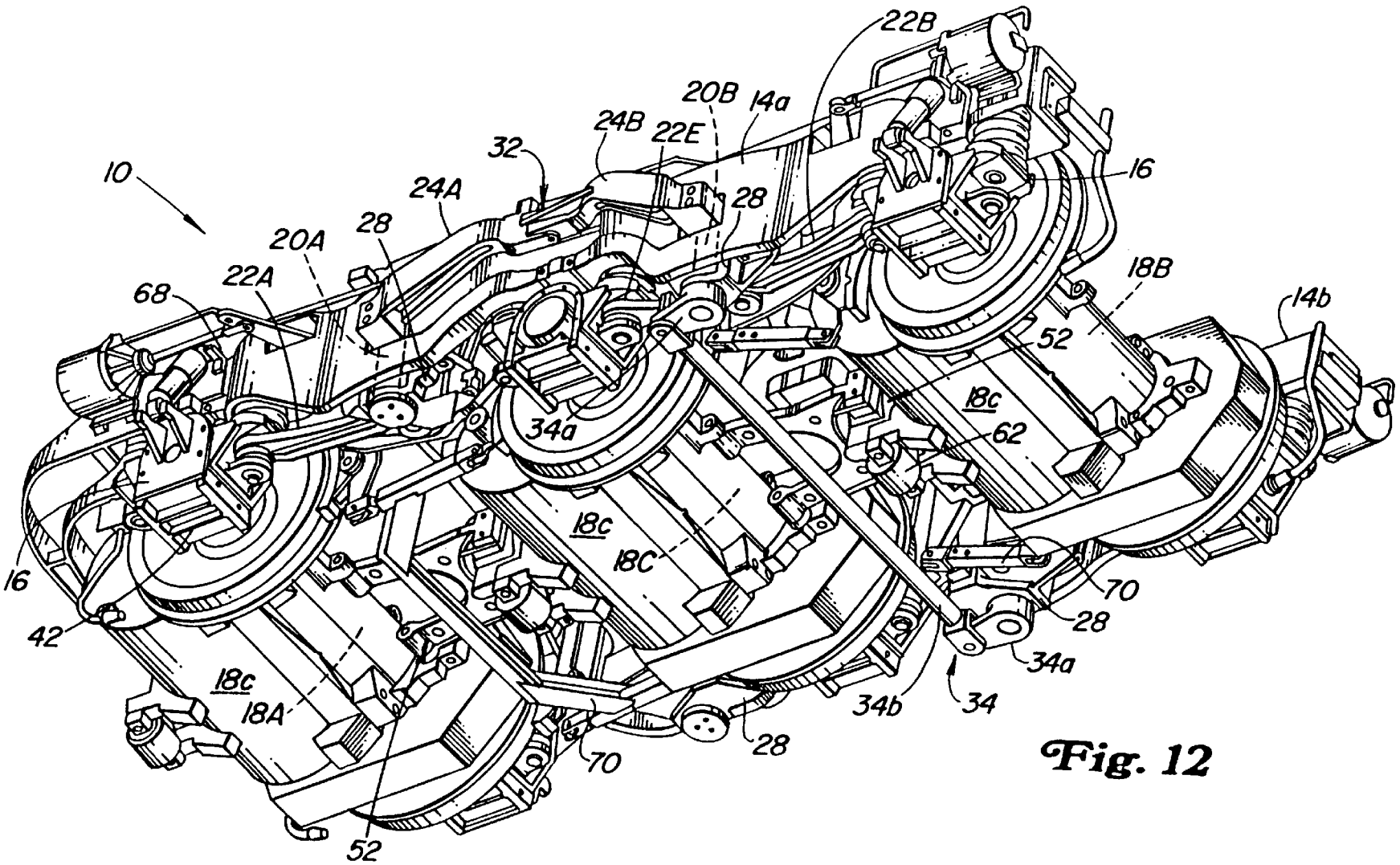
FIG. 12 is an upwardly facing isometric view of the truck illustrated in FIG. 1 from below showing the self-steering linkage assembled therein.

The resulting compact arrangement of the self-steering linkage is illustrated in more particularity in FIG. 12 which shows the underside of the truck 10. In normal operation of the self-steering linkage, the respective components thereof on the opposite side frames 14*a,b* are not otherwise joined together except through the cooperating first and second end axles 18A,B. The traction loads are directly carried to the end traction links 22 to the individual bellcranks 20 joined to the respective side frames 14*a,b*, and self-steering operation is effected by the adjoining first and second reaction arms 24A,B on the first side frame 14*a*, and separately by the adjoining third and fourth reaction arms 24C,D on the second side frame 14*b*.

However, and referring again initially to FIG. 7, it is noted that the lateral reaction loads Rf, Rr between the adjoining reaction arms 24 are a function of the traction loads developed individually by the first and second end axles 18A,B whether during propulsion using the respective motors 18*c* or by using conventional brakes. If the first and second axles 18A,B develop the same traction loads, the reaction loads at the reaction arms 24 will be equal and opposite. If, in one example, the first end axle 18*a* is driven with more traction load than the opposite second end axle 18B, the resulting lateral reaction loads at the adjoining reaction arms will not be equal and opposite with each other thereby effecting a net, non-zero lateral reaction load. Depending upon the direction of the non-zero net lateral load developed either inboard or outboard directed, and depending upon whether the self-steering linkage is negotiating a left curve or a right curve, a small amount of either oversteer or understeer will occur between the opposing end axles 18A,B.

Accordingly, in order to reduce or eliminate under or oversteer of the self-steering linkage due to differential traction loads between the first and second axles 18A,B, balancing means 34, as shown for example in FIGS. 2, 3, and 12, are provided for balancing the lateral reaction loads on opposite sides of the frame 14 in the adjoining reaction arm pairs 24A,B and 24C,D upon differential traction loads between the end axles 18A,B. As shown in FIGS. 3 and 12, the load balancing means 34 preferably include a pair of identical balancing crank arms 34*a* suitably fixedly joined to the bottom ends of respective ones of the crankshafts 20*a* on laterally opposite sides of the truck frame 14. The crank arms 34*a* are illustrated in FIGS. 3 and 12 joined to the aft two bellcranks 20B,D, although they could alternatively be similarly joined to the forward two bellcranks 20A,C. In the preferred embodiment, the crank arms 34*a* are conventionally press fit onto suitable projections formed at the bottom ends of the respective crankshafts 20*a* parallel to each other and having distal ends extending longitudinally toward the first end axle 18A for example. A suitable cross rod or link 34*b* has opposite ends suitably pivotally joined to respective ones of the balancing crank arm 34*a* at the distal ends thereof for carrying tension and compression loads generated therein under differential traction loads effected in the first and second end axles 18A,B. The cross link 34*b* preferably extends laterally perpendicularly to the frame centerline axis CL below the side frames 14*a,b* and below the traction links 22 as shown in FIG. 12 for example. The cross link 34*b* may be otherwise located relative to the opposite bellcranks 20 wherever space permits.

By interconnecting an opposite pair of the bellcranks, such as 20B,D, differential traction loads carried through the bellcranks are balanced through the connecting cross link 34*b* which reduces or prevents understeer and oversteer between the end axles 18A,B. If the differential traction load between the end axles 18A,B is zero, then the cross link 34*b* will similarly carry no tension or compressive load therethrough. The cross link 34*b* therefore has no effect on self-steering unless differential traction loads are developed between the end axles 18A,B.

Figure 13:
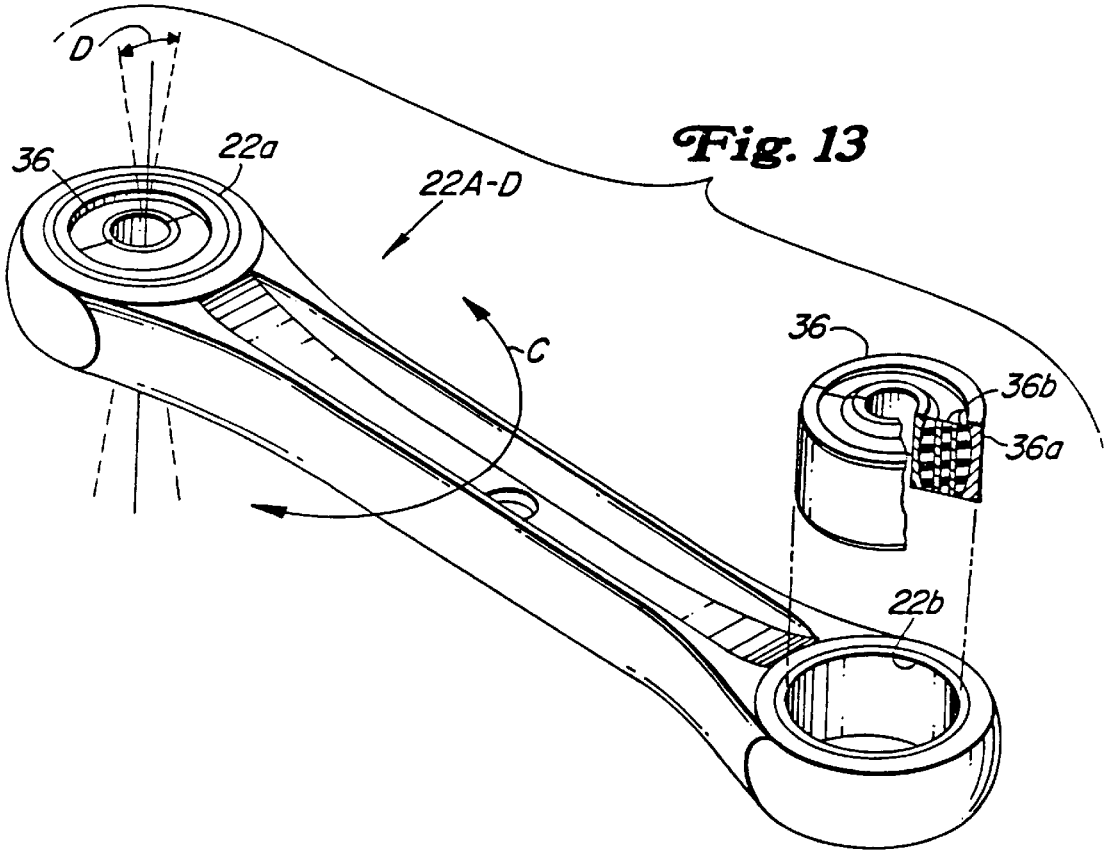
FIG. 13 is an isometric isolated view of an exemplary one of the end traction links for joining the end axles and frame of the truck illustrated in FIGS. 1 and 2 for example.

The four end traction links 22A–D used for joining the end axles 18A,B to the truck frame 14 are preferably identical to each other with an exemplary one thereof being illustrated in more particularity in FIG. 13 and referred to simply by its prefix 22. The traction link 22 is preferably in the form of an elongate beam having first and second bores 22*a* and 22*b* at opposite distal ends thereof which may be formed in a common casting and suitably machined for example. Each of the bores 22*a,b* preferably includes a laminated elastomeric bearing 36 which is suitably press fit and is fixedly mounted in each of the bores 22*a,b*.

As shown in FIG. 2 for example, each of the end traction links 22 is fixedly joined to corresponding end journal boxes 16 and crank arms 20*b* by respective fasteners or link pins 38 extending through the link bearings 36. As shown in FIGS. 4 and 5, the crank arms 20*b* are preferably in the form of a U-shaped fork between which is positioned one end of the traction link 22 so that the link pin 38 may be disposed vertically through corresponding holes in the distal end of the crank arm 20*b* and through the center hole of the bearing 36 for securely mounting the distal end of the traction link 22 to the crank arm 20*b*. The opposite end of the traction link 22 is similarly mounted to the journal box 16 with another one of the link pins 38 extending vertically therein.

Although the bearing 36 could alternatively be in the form of a conventional spherical bearing, the elastomeric bearing 36 is preferred to eliminate wear and contamination problems associated therewith while still providing corresponding degrees of motion including rotation C of the link 22 around the centerline axis of the bearing 36 and the link pin 38 extending therethrough, as well as pivoting or tilting angular movement D of the links 22 askew from the centerline axis of the bearings 36 and the link pins 38 extending therethrough. And, the bearing 36 is preferably substantially stiff in radial compression relative to its centerline axis and the link pin 38 for carrying the traction loads without significant lateral deflection between the journal boxes 16 and the bellcranks 20.

In a preferred embodiment as illustrated in FIG. 13, each of the link bearings 36 comprises a plurality of alternating concentric layers of metal 36*a* and elastomer 36*b* suitably fixedly bonded together. The composition of the bearing 36 may take any suitable conventional form such as a high capacity laminate commercially available from Lord Mechanical Products, a division of Lord Corporation. In a preferred embodiment, each of the link bearings 36 is specifically configured in two diametrically split portions for allowing the bearings 36 to be press fit into the link bores 22*a,b*. The effective radial stiffness of the link bearings 36 may be on the order of 1.2 million pounds per inch, and therefore the bearings 36 could not be effectively installed into the bores 22*a,b* without being initially diametrically split in two portions for example.

The traction links 22 are illustrated in FIG. 2 installed between the respective end journal boxes 16 and bellcranks 20, with the bores 22*a,b* in this embodiment being coplanar and parallel with each other, with the vertical centerline axes of the bores 22*a,b* and the bearings 36 therein extending substantially vertically. In this configuration, lateral movement of the end axles 18A,B is permitted without restraint by the links 22 which are allowed to freely rotate about the respective end bearings 36 therein. Lateral restraint of the end axles 18A,B is otherwise provided by the journal boxes 16 as described in more detail later hereinbelow. The journal boxes 16 experience limited vertical travel during operation which is accommodated by the pivoting rotation D relative to the centerline axes of the link bearings 36 during operation. The links 22 and elastomeric link bearings 36 therein therefore allow effective lateral and vertical differential movement between the end journal boxes 16 and the vertically constrained crank arms 20*b* while effectively carrying the substantial traction loads through the links 22 in compression or tension depending upon the traction load direction.

As indicated above, the four traction links A-D are identical to each other and similarly installed in the self-steering linkage for carrying respective portions of the traction loads while allowing self-steering of the end axles 18A,D. Although the second or middle axle 18C as illustrated in FIG. 1 is not a component of the self-steering linkage assembly, it also is similarly mounted in corresponding middle journal boxes 16 to the side frames 14*a,b* and is additionally attached thereto by a pair of identical fifth or middle traction links 22E. One end of the middle traction link 22E is joined to the middle journal box 16 as illustrated in FIG. 12, with the opposite end of the middle link 22E being suitably joined to corresponding ones of the traction caps 28 as described in more detail later hereinbelow. Additional details of the middle traction links 22E are also additionally described later hereinbelow.

The basic self-steering linkage described above is relatively simple and compact and is integrated preferably directly inside the truck frame 14 in major part for providing improved self-steering of the truck 10 with improved hunting stability. Additional features of the present invention include the improved journal box 16 which is modular configuration providing significant advantages in improving assembly and alignment of the self-steering linkage in all three axles 18A–C.

Modular Journal Box

In accordance with another feature of the present invention, the journal boxes 16 are preferably identical and modular so that they may be used for supporting the axles 18 at any position in the truck frame 14 without requiring specifically configured boxes therefor which would otherwise increase cost and inventory requirements. The journal boxes 16 may be readily opened or closed for assembling or disassembling the axles 18 therewith and improve the ability to align the several axles 18 during the assembly process.

Figure 15:
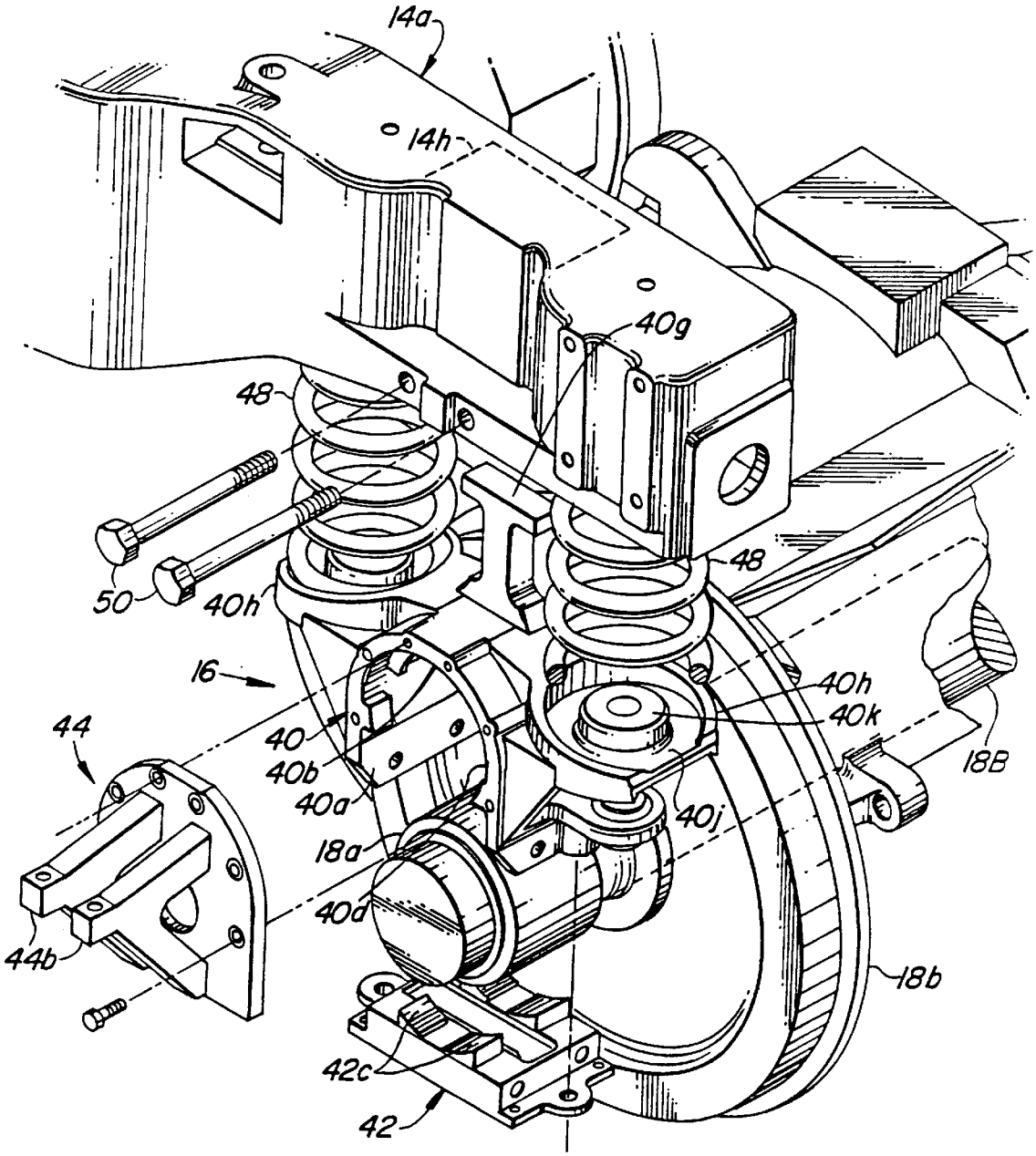
FIG. 15 is an isometric exploded view of an exemplary one of the truck axles mounted in a respective journal box which in turn is suspended from the truck side frame.
Figure 16:
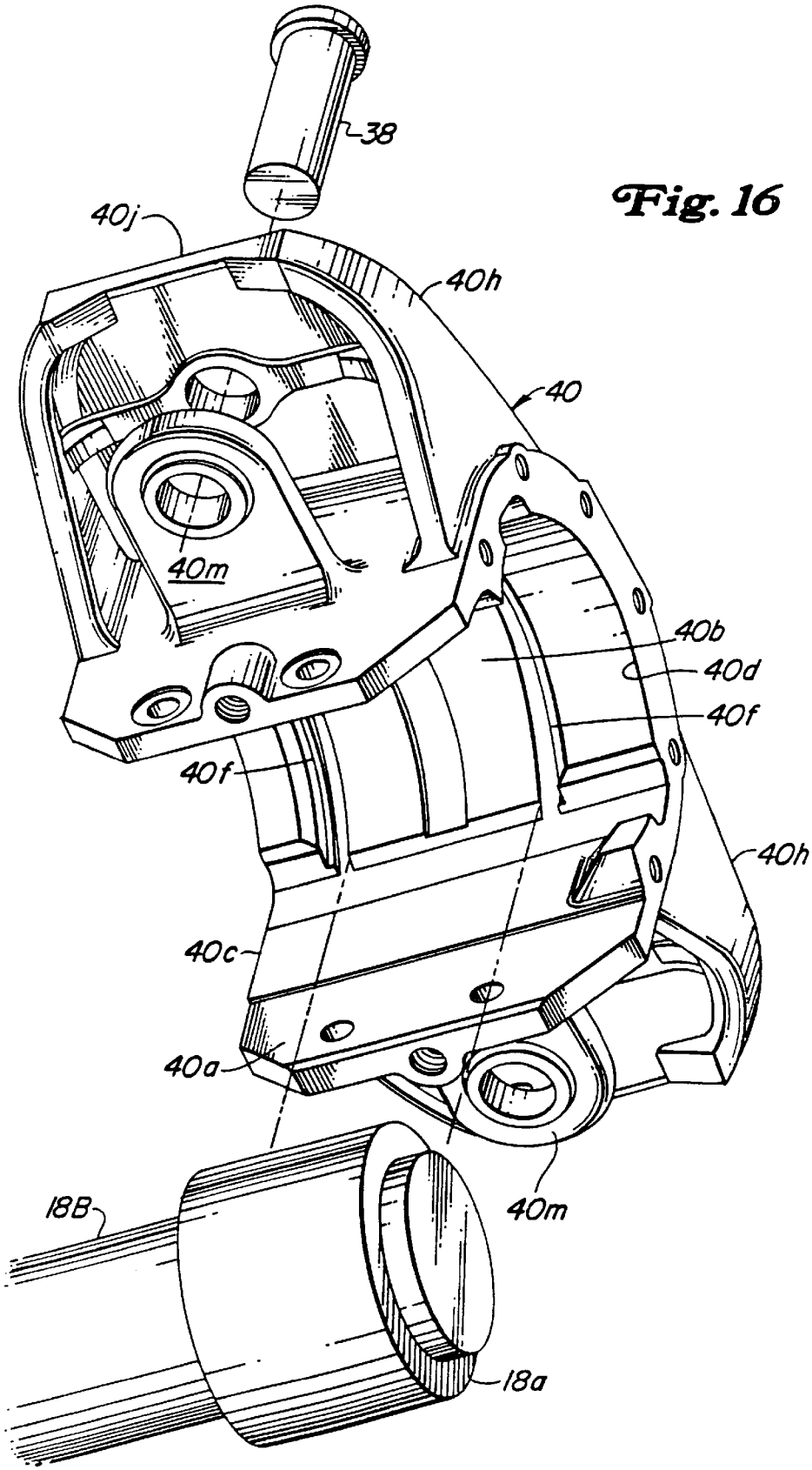
FIG. 16 is an isometric upward facing view of a main housing of the journal box illustrated in FIG. 15 showing in exploded view mounting of an axle bearing therein.
Figure 17:
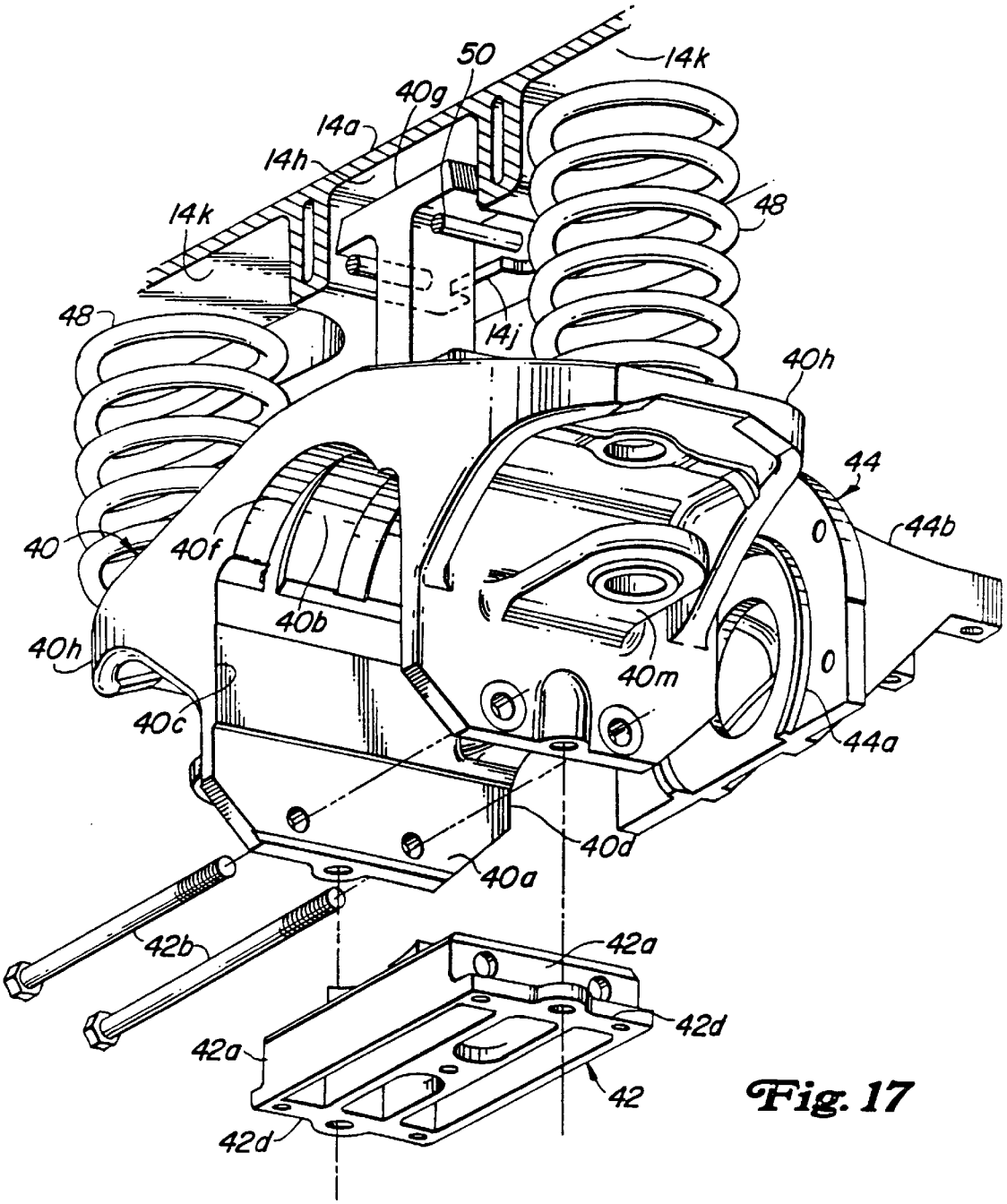
FIG. 17 is an isometric, upwardly facing, partly exploded view of the journal box illustrated in FIG. 15 suspended from the truck side frame.
Figure 18:
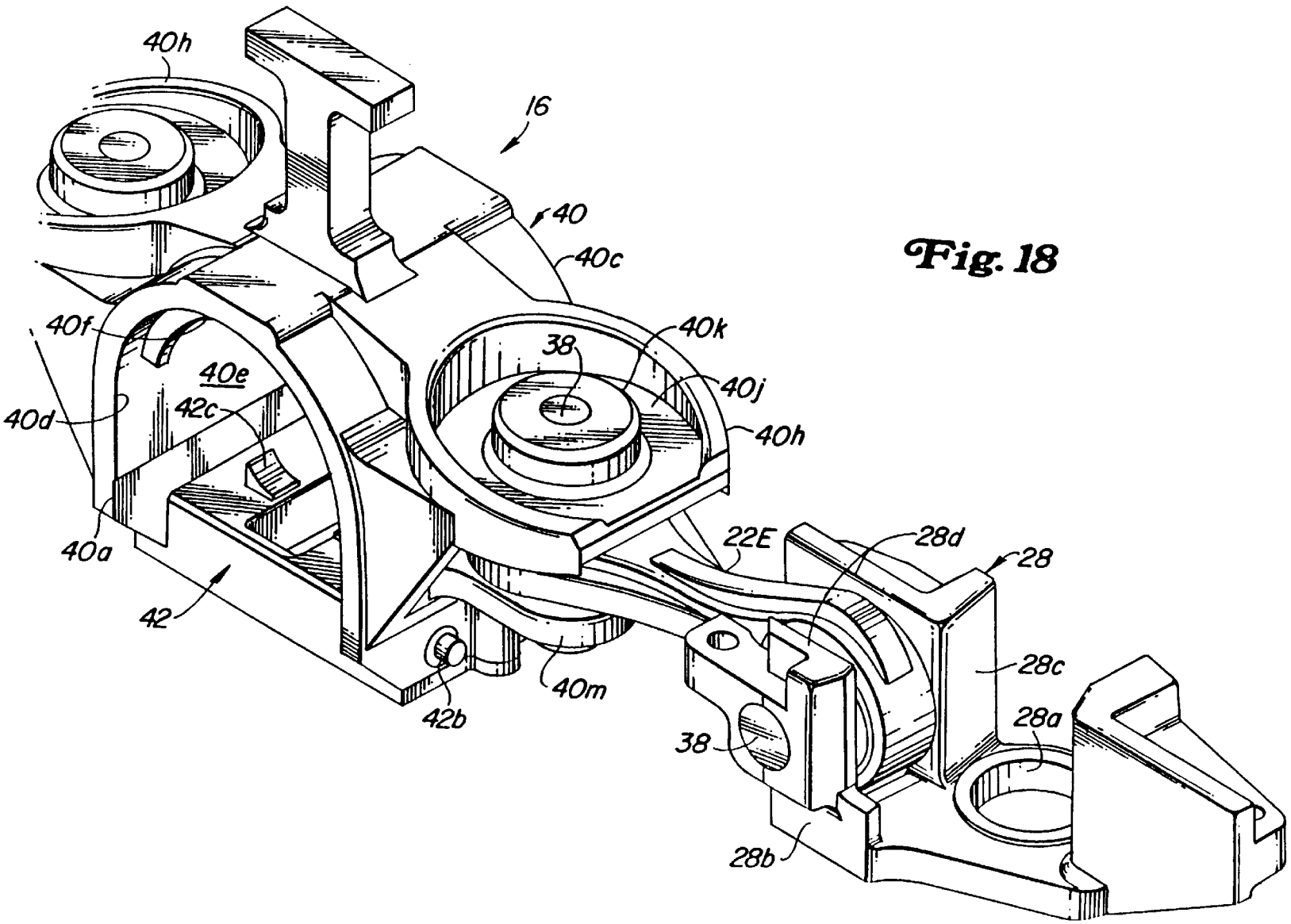
FIG. 18 is an isometric view of an exemplary middle journal box for mounting the middle axle of the truck illustrated in FIG. 12 to a corresponding side frame thereof.

More specifically and referring initially to FIGS. 15 and 16, an exemplary one of the journal boxes 16 for supporting one of the end bearings 18*a* of the second end axle 18B is illustrated in exploded form. The other journal boxes 16 identically support the remaining end bearings 18*a* of the other axles. Each of the journal boxes 16 includes a preferably U-shaped main housing 40 which is inverted and resiliently suspended from the side frame 14*a* as described in more detail later hereinbelow, and includes a downwardly facing rectangular access opening defining a cap seat 40*a*, and an opposite arcuate bearing seat 40*b* disposed vertically above the cap seat 40*a* for receiving a respective one of the axle bearings 18*a* on corresponding ends of the axle. The main housing 40 further includes an inboard aperture 40*c* through which the axle 18B extends, and a laterally opposite outboard aperture 40*d* at which the axle terminates. As shown in FIGS. 15 and 17, a removable housing cap 42 is fixedly joined to the cap seat 40*a* for retaining the axle bearing 18*a* in the axle bearing seat 40*b* and completing the perimeter of the main housing 40 for structurally stiffening the housing 40 for withstanding various static and dynamic loads carried therethrough during operation. FIG. 18 illustrates an identical journal box 16 for the middle axle 18C (not shown) wherein the housing cap 42 is assembled to the housing 40 without the end bearing therein for clarity of presentation. The housing 40 and cap 42 together define a bore 40*e* which extends through the housing 40 from the inboard to outboard apertures 40*c,d* which has a longitudinal centerline axis which is coincident with the longitudinal centerline axis of the axle 18 when mounted therein.

Referring again to FIG. 15, it is readily seen that the removable cap 42 allows the individual axles 18 to be simply installed into the main housings 40 for assembly after the main housings 40 are preassembled to the side frames 14*a,b* and aligned and trammed as described in more detail later hereinbelow. Seating of the bearing 18*a* into the axle bearing seat 40*b* carries respective portions of the vertical loads of the truck 10, and locomotive body thereon, onto the bearings 18*a* which maintains the bearing seat 40*b* and the bearings 18*a* in abutting contact. The housing cap 42 therefore does not experience any of the downward vertical loads on the bearing 18*a*, but merely structurally stiffens the main housing 40 and carries any upward vertical forces on the axles 18 which would occur typically upon lifting the entire truck 10 during a maintenance outage for example.

As shown in FIG. 16, the bearing 18*a* includes an annular housing, and the axle bearing seat 40*b* is configured and sized for receiving the bearing 18*a* at least along an arcuate upper portion thereof from about a ten o'clock to a two o'clock arcuate extent for suitably carrying the vertical loads between the bearing 18*a* and the housing 40 without undesirable pinching of the bearing 18*a* itself. The bearing seat 40*b* is a suitably machined surface for accurately matching the outer circumference of the bearing 18*a* and providing even abutting contact therebetween. In the exemplary embodiment, the bearing 18*a* includes two axially spaced apart rows of tapered roller bearings for accommodating both radial and thrust loads, and therefore the bearing seat 40*b* includes two axially spaced apart arcuate portions which are aligned coextensively with the respective tapered roller portions of the bearing 18*a*. The housing 40 further includes a pair of integral, laterally spaced apart arcuate side flanges or ridges 40*f*, also referred to as retention eyebrows, which laterally bound the bearing seat 40*b* for laterally restraining the bearing 18*a* therebetween. In this way, lateral loads from the axles 18 are carried through the bearing 18*a* and into the housing 40 through either of the side ridges 40*f*.

As shown in FIG. 15, the housing cap 42 is configured and sized for adjoining at least an arcuate lower portion of the bearing 18*a* for allowing assembly and disassembly of the axles with the housings 40. Since the cap seat 40*a* is preferably a rectangular opening, the housing cap 42 is similarly rectangular and complementary with the cap seat 40*a* for being fixedly joined thereto for stiffening the housing 40. The cap 42 includes accurately machined end surfaces 42*a*, as illustrated in FIG. 17 for example, which accurately mate with corresponding surfaces of the cap seat 40*a*. Two removable cap fasteners 42*b* in the form of long pins or bolts, extend laterally through corresponding holes in the side legs of the housing 40 at the cap seat 40*a* and through the housing cap 42 for fixedly joining the cap 42 to the cap seat 40*a*. The through fasteners 42*b* extend generally perpendicular to the primary axis of the housing bore 40*e* as best shown in FIG. 18. which is in the longitudinal direction of the side frames 14*a,b* as shown in FIG. 15. Upon tightening the fasteners 42*b* during assembly, the corresponding flat surfaces of the housing cap 42 and cap seat 40*a* compress against each other to stretch the fasteners 42*b* and stiffen the housing 40 against structural loads during operation.

As illustrated in FIG. 15, the cap 42 is preferably in the form of a relatively thick rectangular plate, which preferably includes a plurality of arcuate raised retention bosses or lands 42*c* which collectively define a lower arc for adjoining the bearing lower portion and vertically retaining the bearing 18*a* in the housing 40, upon lifting of the truck 10 for example. The lands 42*c* may take any suitable form such as the respective two pairs of spaced apart lands 42*c* illustrated in FIG. 15 which are respectively coextensive with the corresponding two rows of the tapered rollers in the bearing 18*a*. The lands 42*c* in conjunction with the bearing seat 40*b* define a substantially cylindrical housing bore 40*e* in which is mounted the corresponding cylindrical housing of the bearing 18*a*.

As shown in FIG. 17, the housing cap 42 may have suitable pockets therein which lighten the weight of the cap 42 while still maintaining structural rigidity thereof. And, the cap 42 preferably includes a pair of opposite side flanges 42*d* which abut respective lower end portions of the housing 40 defining the cap seat 40*a* when assembled. The side flanges 42*d* preferably includes middle apertures through which may extend a pair of bolts (not shown) for drawing the cap 42 against the cap seat 40*a* during assembly, with the bolts threadingly engaging corresponding threaded apertures in the side legs of the housing 40. The side flanges 42*d* further include four threaded apertures at the four corners thereof so that additional bolts (not shown) may be threadingly engaged therein to abut the lower edges of the side legs of the housing 40 so that tightening of these bolts will withdraw the cap 42 for disassembly from the housing 40. The through fasteners 42*b* are either inserted through the housing 40 and cap 42 after they are drawn together, or removed therefrom prior to removing the cap 42.

As illustrated in FIG. 15, each of the end journal boxes 16 further includes an adapter or end plate 44 which is removably fixedly joined to the housing 40 over the outboard aperture 40*d* by a plurality of suitable fasteners or bolts spaced around the perimeter thereof and into the housing 40. The end plate 44 not only additionally stiffens the housing 40 but also provides an effective attachment point for conventional dampers 46 as shown for the two end axles 18A,B illustrated in FIG. 1. Each damper 46 is suitably fixedly joined to the end plate 44 at one end thereof, and to a respective one of the side frames 14*a,b* at an opposite end thereof for damping vibration between the truck frame 14 and the journal boxes 16 which support the axles 18.

As shown in FIG. 17, the end plate 44 includes an inboard face having an arcuate boss or end ridge 44*a* which is complementary with the housing outboard aperture 40*d*, and is disposed therein in abutting contact therewith for carrying vertical loads from the end plate 44 to the housing 40 during operation. In the exemplary embodiment illustrated in FIG. 17, the end ridge 44*a* is a portion of a circular arc extending from about seven o'clock to about five o'clock in circumferential extent and fits within the correspondingly configured outboard aperture 40*d* as illustrated in more particularity in FIG. 16. Vertical loads are carried between the housing 40 and the end plate 44 through the end ridge 44*a* and not by the mounting fasteners which secure the end plate 44 to the housing 40.

As shown in FIG. 15, the end plate 44 also includes an opposite outboard face having a pair of spaced apart, cantilevered end gussets 44*b* extending outboard therefrom for fixedly supporting thereto the corresponding end of the damper 46 thereto. Each of the end gussets 44*b* is in the exemplary form of a Y-shaped member with the head of the Y being integrally joined to the outboard face of the end plate 44, by welding for example. The base of the Y extends outboard, with each base including a through aperture for receiving a corresponding fastener for securing the damper 44 thereto. The end plate 44 also has a central through hole for accessing axle devices such as alternators.

The primary suspension of the truck 10 includes a pair of conventional compression coil springs 48 illustrated in FIG. 15 which extend between each of the journal boxes 16 and a respective portion of the side frames 14*a,b*. The springs 48 are initially partly compressed when the journal boxes 16 are assembled to the frame 14, and each of the journal boxes 16 preferably also includes a catch hook 40*g* which is an integral portion of the main housing 40 and extends vertically upwardly into a corresponding catch pocket 14*h* disposed in the bottom of respective portions of the side frames 14*a,b* as illustrated in more particularity in FIGS. 17 and 19. The catch hook 40*g* is preferably vertically aligned with the center of gravity of the journal box 16, and the bearing 18*a* therein, and is used for predeterminedly limiting both longitudinal and lateral movement of the journal box 16 relative to the frame 14 and for retaining the journal box 16 vertically relative to the frame 14.

More specifically, and as shown in FIG. 15 and 17, the catch hook 40*g* is preferably T-shaped, and a pair of catch pins 50 extend through corresponding holes in respective ones of the side frames 14*a,b* and through the respective catch pockets 14*h* and below the head portion of the catch hook 40*g* to limit vertically downward travel of the journal boxes 16 relative to the side frames 14*a,b*. As shown in FIG. 17, in the event the truck 10 is lifted during a maintenance outage for example, the T-shaped catch hook 40*g* will engage the two adjacent catch pins 50 preventing the journal box 16 from being removed unless the catch pins 50 are firstly removed. The catch hook 40*g* is preferably sized relative to the catch pocket 14*h* and spaced from the catch pins 50 to limit longitudinal and lateral travel of the journal boxes 16 relative to the side frames 14*a,b*, while allowing limited differential vertical movement therebetween. Longitudinal travel of the journal box 16 in either a forward or reverse direction relative to the truck frame will cause the catch hook 40*g* to abut opposite ones of the catch pins 50 and thereby limit longitudinal travel.

Figures 19, 20:
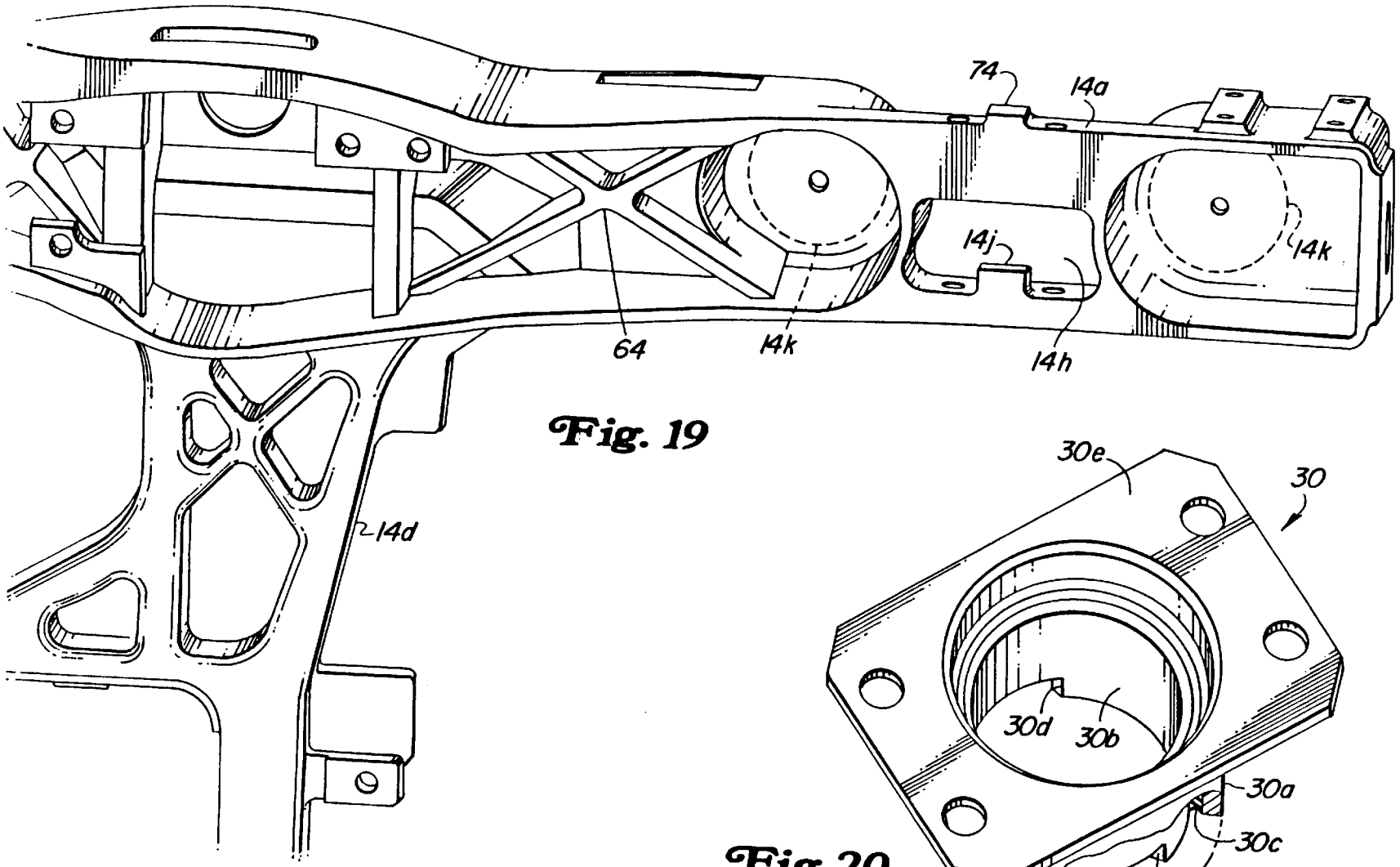
FIG. 19 is an upward facing view of an end of one of the side frames of the truck illustrated in FIG. 1 showing upper springs seats for supporting the journal box illustrated in FIG. 17.
FIG. 20 is an isometric isolated view of one embodiment of the yaw stiffener illustrated in FIG. 8.

Each of the side frames 14*a,b* preferably further includes an outboard facing raised lateral boss 14*j*, as shown in FIGS. 17 and 19, in each of the catch pockets 14*h* aligns which is aligned with respective ones of the catch hooks 40*g* and spaced therefrom for limiting lateral inboard travel of the catch hook 40*g* by abutting contact therewith. The journal boxes 16 on opposite sides of the truck frame 14 work in concert for supporting the individual axles 18. Lateral movement of one of the boxes 16 in the inboard direction will be limited by abutting contact of the catch hook 40*g* as shown in FIG. 17 against the corresponding lateral boss 14*j*. Lateral movement in the opposite direction will be limited by the catch hook 40*g* and corresponding boss 14*j* on the opposite side of the truck frame 14. The catch hooks 40*g* therefore also limit the allowed travel of the traction links 22 which are joined to the respective journal boxes 16.

The journal boxes 16 are preferably identical to each other and modular in construction so that they may be used at any axle location on the truck frame 14, and may be joined to respective ones of the traction links 22 for effecting self-steering of the axles 18, as well as carrying respective portions of the traction loads. In this regard, and as shown in FIGS. 15–17, each of the journal boxes 16 preferably includes a pair of gussetted wings 40*h* which extend oppositely from each of the journal box housings 40 integral therewith and adjacent to the axle bearing seat 40*b*. The wings 40*h* extend longitudinally relative to the centerline axis of the truck frame 14 and perpendicular to the respective axles 18. Each housing wing 40*h* includes an upwardly facing lower spring seat 40*j*, as shown more clearly in FIGS. 15 and 18, which receives the bottom end of respective ones of the coil springs 48. As shown in FIGS. 17 and 19, each of the side frames 14*a,b* includes a plurality of downwardly facing upper spring seats 14*k* for receiving the upper ends of the coil springs 48. The upper spring seats 14*k* are in the exemplary form of blind recesses in the side frames 14*a,b* in which are captured the top ends of the coil springs 48. The lower spring seats 40*j* as shown in FIGS. 15 and 18 define annular pockets having a center boss 40*k* for laterally retaining the lower end of the coil springs 48. In this way, the coil springs 48 are mounted between the journal boxes 16 and the side frames 14*a,b* between respective lower and upper spring seats 40*j* and 14*k* for vertically supporting the truck frame 14 on the journal boxes 16.

In order to suitably affix the respective traction links 22 to the journal boxes 16, each housing 40 further includes a pair of support legs or ledges 40*m*, as shown for example in FIG. 16, which are in the form of a cantilever plates extending oppositely from each of the housings 40 and integral therewith adjacent to the axle bearing seat 40*b* and generally parallel with the housing wings 40*h*. Respective ends of the traction links 22 may be fixedly joined to the journal boxes 16 at the supporting ledges 40*m*. As shown in FIG. 18 for example, each of the ledges 40*m* is preferably horizontal and extends generally radially outwardly from the housing bore 40*e*, and from the axle bearing 18*a* supported therein, and is positioned relative to the axle bearing 18*a* for mounting each of the traction links 22 generally coplanar with the center thereof for carrying the traction loads therebetween without undesirably providing reaction torque on the journal boxes 16.

As shown in FIG. 16 for example, respective pairs of the wings 40*h* and ledges 40*m* are vertically spaced apart from each other for vertically retaining a respective end of a traction link 22 therebetween (as shown in FIG. 18 for example). The ledge 40*m* and corresponding lower spring seat 40*j* as shown in FIGS. 16 and 18 preferably include vertically aligned holes containing suitable bushings for receiving a respective one of the link pins 38 extending therethrough and through the corresponding end of a traction link 22. In this way, the traction loads carried by the links 22 are carried both by the supporting legs 40*m* and the corresponding housing wing 40*h* joined to the journal box housing 40. The traction links 22 may therefore be aligned generally coplanar with the centerline axis of the axle bearings 18*a* for eliminating undesirable torque moments on the journal box 16 during operation. The supporting legs 40*m* and corresponding wing 40*h* which define a pocket for receiving a corresponding end of the traction links 22 preferably include bosses which adjoin the link ends to limit vertical movement therebetween. The traction links 22 are therefore allowed to rotate relative to the journal boxes 16 about the link pins 38 in the C direction illustrated in FIG. 2 while additionally enjoying pivoting or tilting angular movement in the D direction also illustrated in FIG. 2.

As indicated above, the journal boxes 16 are identical in configuration and modular for being used at any axle position. As shown in FIG. 2 for example, the end traction links 22A–D are joined to one pair of the wings 40*h* and ledges 40*m* on one side of the end journal boxes for the first end axle 18A, and to an opposite pair of wings 40*h* and 40*m* on an opposite side of the other end journal boxes 16 for the second end axle 18B. The remaining pairs of wings 40*h* and ledges 40*m* on these end journal boxes 16 remain empty of traction links. In this way the same journal box 16 may be used at any position and reduce inventory requirements.

The end links 22A–D are identical to each other at the four corners of the truck as illustrated in FIG. 2, with the first and second bores 22*a,b* (see FIG. 13) being coplanar and disposed in the generally common horizontal plane. This adds to the modularity of construction of the suspension system and self-steering linkage.

Figure 14:
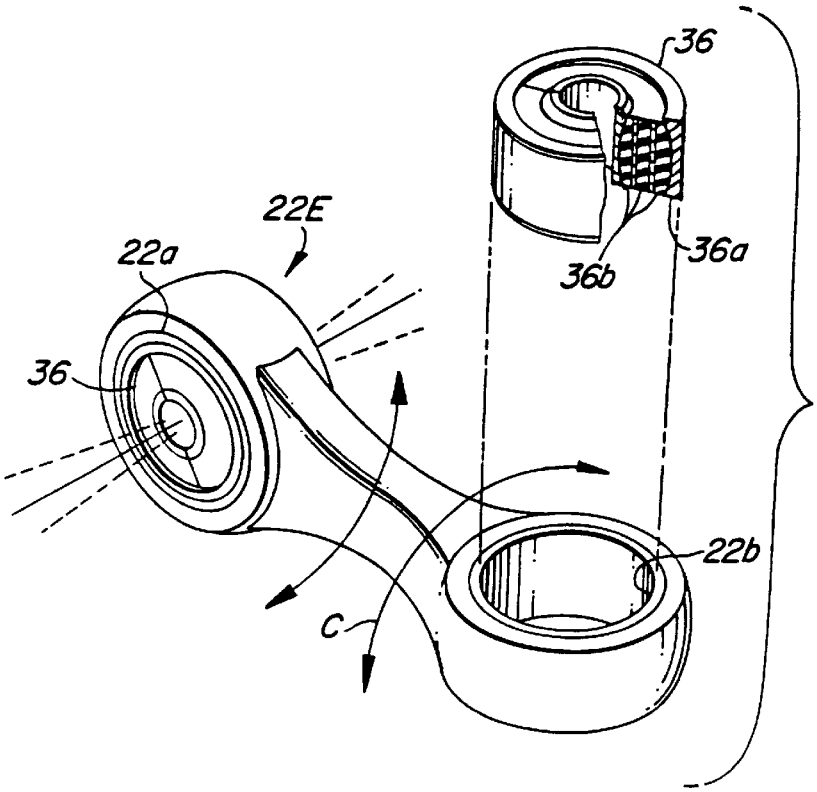
FIG. 14 is an isometric isolated view of another embodiment of a middle traction link for joining a middle axle to the truck frame as illustrated in FIGS. 2 and 12 for example.

Although the middle axle 18*c* illustrated in FIGS. 1 and 12 does not form a portion of the self-steering linkage, it too may be mounted using the identical and modular journal boxes 16 with a relatively simple modification in configuration and size of the middle traction links 22E shown therein, and in more particularity in FIGS. 14 and 18. As shown in FIG. 18 for example, in conjunction with FIG. 2, any pair of the traction caps 28 on opposite sides of the side frames 14*a,b* adjacent to the middle axle 18C may each further include a link fork 28*d* which receives and pivotally mounts a respective end of the middle traction links 22E for carrying the tension and compression traction loads therebetween during operation. A corresponding link pin 38 extends laterally through corresponding holes in the link fork 28*d* and through the bearing 36 in the link end.

As shown in FIG. 14, the first and second bores 22*a,b* for the middle traction links 22E are oriented 90° from each other so that the first bore 22*a* extends horizontally for being mounted in the link fork 28*d*, and the second bore 22*b* extends vertically for being mounted between the support leg 40*m* and the corresponding housing wing 40*h* of the middle journal box 16. The middle traction links 22E are substantially shorter than the end traction links 22A–D, with the twisted configuration of the middle links 22E allowing a suitably large vertical travel of the middle journal boxes 16 relative to the link fork 28*d* of the adjacent traction caps 28. The middle links 22E illustrated in FIG. 18 have unrestricted vertical rotational movement around the horizontal link pins 38 extending through the link fork 28*d*, and unrestricted rotational movement about the vertical link pins 38 extending through the journal boxes 16. Their rotation is limited solely by limiting movement of the middle journal boxes 16 to which they are attached.

Accordingly, the modular construction of the journal boxes 16 disclosed above allows their use at any axle position in the truck frame 14 irrespective of orientation of the various traction links 22. Only the middle traction links 22E need have a different configuration than the end traction links 22A–D for using the common journal box 16 at the middle axle location. The removable housing caps 42 allow relatively easy assembly of the heavy axle assemblies including the motors thereon into the respective journal boxes 16, and correspondingly relatively easy disassembly thereof by simply removing the housing caps 42. In this way, the entire journal box 16 and self-steering linkage attached thereto need not be removed for removing individual axles 18 during maintenance. The modular journal boxes 16 also provide significant advantage in aligning and tramming the axles 18 during assembly which is described in further detail later hereinbelow.

The journal boxes 16 and the coil springs 48 define the primary suspension for mounting the truck frame 14 to the axles 18. The journal boxes 16 must permit greater lateral and yaw movement of the end axles 18A,B for effecting desirable self steering therebetween, but correspondingly affect hunting stability. It is therefore desirable to provide yaw constraint to improve hunting stability without compromising self steering. This is accomplished in part by the elastomeric shear pads 32*e* adjoining the wing plates 32*c* in the joints between the reaction arms 24. Shearing of the pads 32*e* effects a restoring force against differential movement between the adjoining arms.

Yaw Stiffener

However, substantially more yaw constraint and restoring torque may be provided by using the yaw stiffeners 30 introduced above and illustrated in FIG. 8. The yaw stiffeners 30 add significant yaw constraint to the self steering linkage without affecting the performance of the primary suspension coil springs 48 which is essential to good ride quality. The restoring torque may be selected independent of other self-steering linkage elements to provide the best compromise between hunting stability requiring larger torque restraint, and curving performance requiring less torque restraint.

Figure 21:
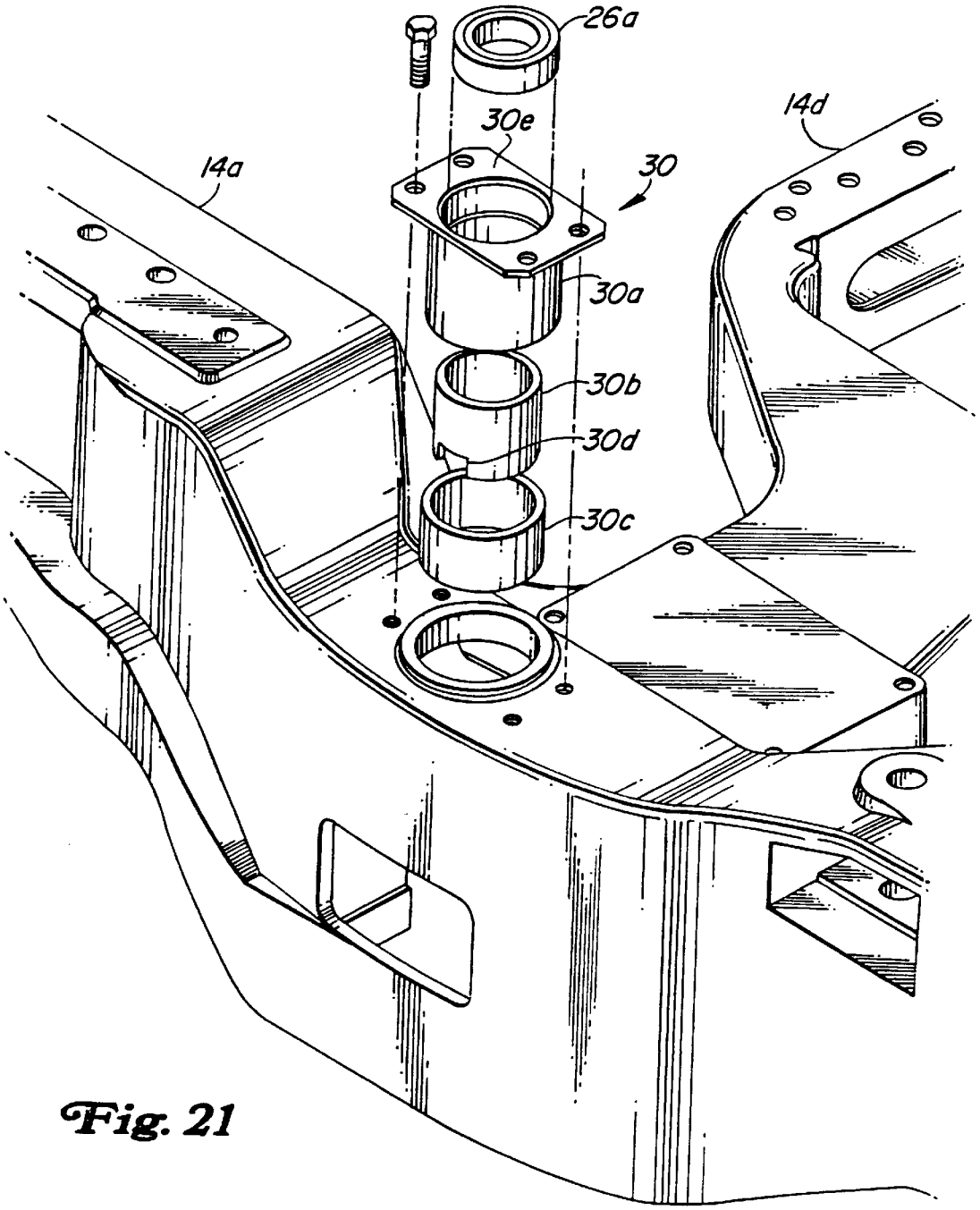
FIG. 21 is an exploded view of the yaw stiffener illustrated in FIGS. 8 and 20 shown being assembled in one of the side frames for receiving a respective bellcrank.

More specifically, the yaw stiffener 30 Illustrated in FIG. 8, and additionally in FIGS. 20 and 21, is in the form of a torque tube and includes a metal cylindrical outer sleeve 30*a* which extends downwardly inside the side frames 14*a,b* from the tops thereof and is suitably fixedly joined thereto by conventional fasteners or bolts. A metal cylindrical inner sleeve 30*b* is disposed coaxially inside the outer sleeve 30*a* and Is removably fixedly joined to the crankshaft 20*a*. An elastomeric or rubber middle sleeve 30*c* is disposed coaxially radially between the outer and inner sleeves 30*a,b* and is suitably fixedly bonded thereto. The inner sleeve 30*b* has a pair of diametrically opposite notches 30*d* disposed in the bottom end thereof which engage or mate with a pair of complementary lugs 20*c* in the mid portion of the bellcrank 20 as shown in FIG. 8, and additionally in FIG. 5. The crank lugs 20*c* engage the yaw stiffener notches 30*d* so that rotation of the bellcranks 20 is opposed by a countertorque generated by the elastomeric middle sleeve 30*c* of the yaw stiffener 30 which undergoes torsional shear between the outer and inner sleeves 30*a,b* for improving hunting speed.

In the exemplary embodiment illustrated, the outer sleeve 30*a* includes an integral flat mounting flange 30*e* at its top end which is suitably bolted to the top of the side frame 14*a,b*, with the outer sleeve 30*a* being disposed inside the side frame 14*a,b*. The first bearing 26*a* shown in FIG. 8 is suitably initially press fit into the top of the outer sleeve 30*a*, with the entire yaw stiffener assembly being installed into the corresponding hole therefor formed in the top of the side frame 14*a,b*. The pair of notches 30*d* are disposed in the bottom end of the inner sleeve 30*b* to mate with the crank lugs 20*c*. In this way, the bellcranks 20 are suitably rotatably mounted to the side frames 14*a,b* via the respective traction caps 28 and yaw stiffeners 30 at opposite ends thereof, with the yaw stiffeners providing desirable restoring torque as the crankshafts 20*a* rotate to effect self steering.

The yaw stiffeners 30 may be configured in different embodiments, for example completely atop the side frames 14*a,b* if desired. In this case the top bearing 26*a* would be directly mounted in the side frames 14*a,b* themselves. The stiffener outer sleeve would be suitably attached to the side frame 14*a,b* in a corresponding housing therefor, and the inner sleeve would mate with the exposed end of the crankshaft 20*a* which could have a suitable key fitting the notches at the bottom of the inner sleeve.

Accordingly, various embodiments of the yaw stiffeners may be developed to provide suitable restoring torque on the bellcranks 20, and thereby improve hunting stability.

Interaxle Linkage

As indicated above, a self-steering railway truck requires increased lateral and yaw motion for effecting self-steering. Disclosed above are exemplary solutions for improving hunting performance notwithstanding the increased lateral and yaw motion capability of the self-steering axles. For example, the self-steering linkage disclosed above may be used for coupling lateral and yaw motion of the end axles, with the laterally coupled axles having improved hunting performance.

In accordance with another feature of the present invention, it is desired to further laterally couple together adjacent ones of the axles 18 for yet further improving hunting performance in a relatively simple configuration with relatively few parts and joints. Furthermore, it is also desirable to laterally interconnect the adjacent axles so that they may nevertheless be readily assembled and disassembled with the journal boxes 16 which improves maintenance capability.

Yet further, by laterally interconnecting the axles 18, the self-steering of the axles may be enhanced. For example, as the locomotive approaches a curve, the leading axle will run to the outside rail due to the radius differential between the outside and inside rail and the conicity of the wheels. As the leading axle positions itself to the outside rail, it forces the trailing axle(s) to the outside rail as well, which therefore better positions them for negotiating the curve. This results in lower lateral forces between the wheels and the rails, better adhesion characteristics in curves, and most likely lower wheel tread and flange wear.

Figure 22:
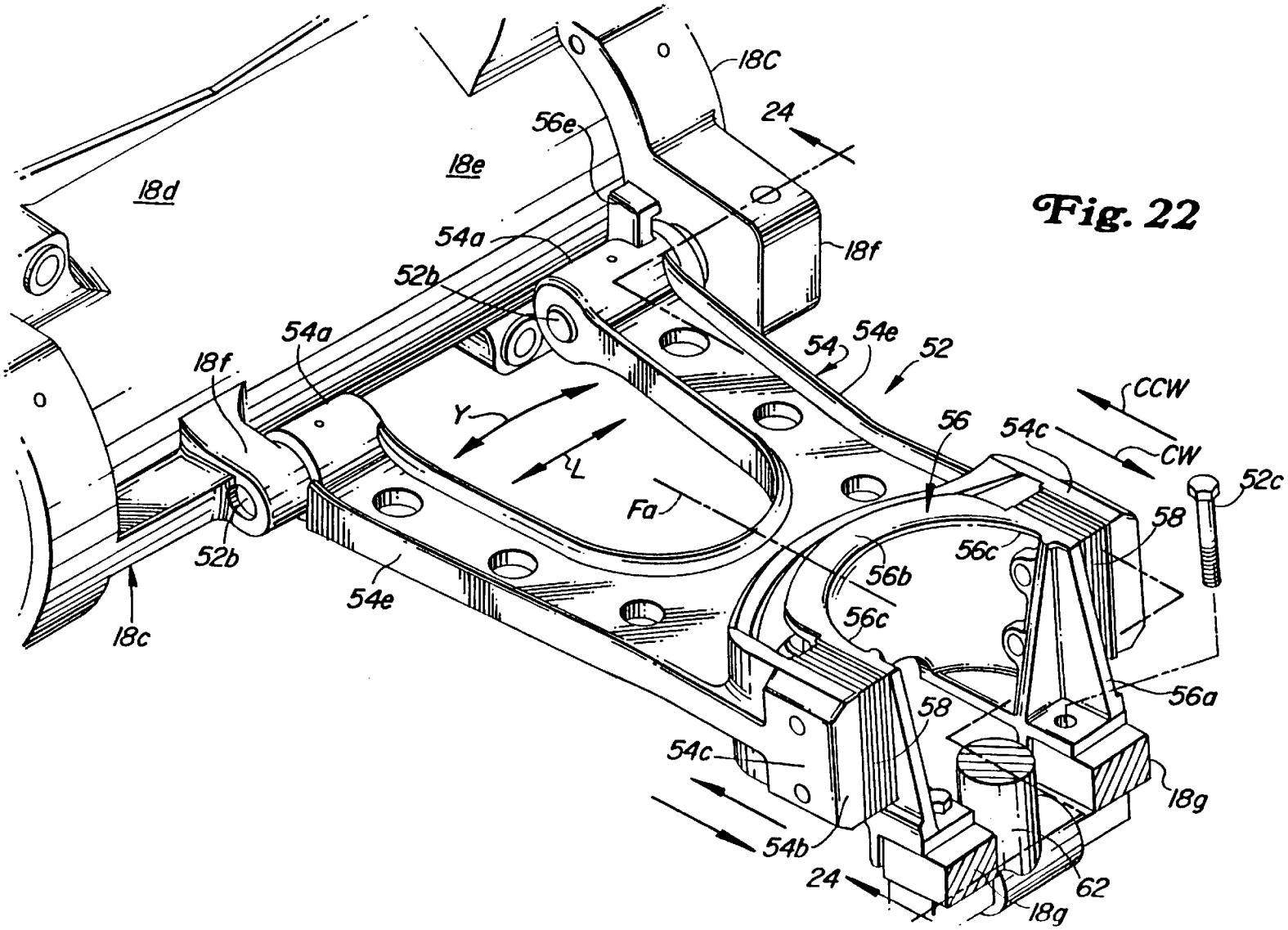
FIG. 22 is an isometric view of an interaxle linkage laterally interconnecting adjacent axles of the truck illustrated in FIG. 12 in accordance with one embodiment of the present invention.
Figure 23:
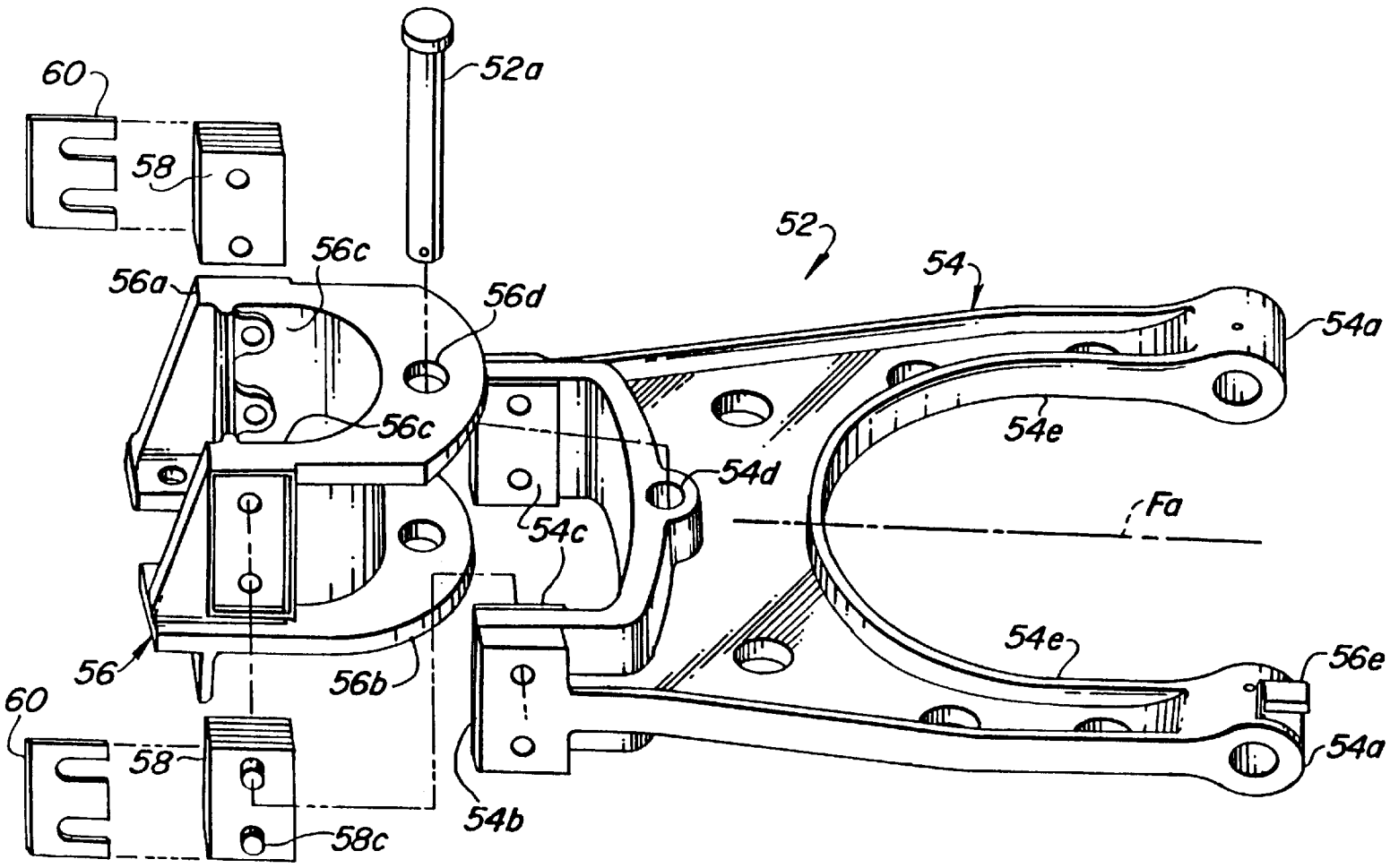
FIG. 23 is an exploded isometric view of the exemplary interaxle linkage illustrated in FIG. 2.

FIGS. 22–23 illustrate an exemplary embodiment of an intermotor or interaxle linkage 52 which provides means for laterally interconnecting adjacent axles 18 so that lateral translation of one axle effects corresponding lateral translation of the adjacent axle, while allowing relative vertical and longitudinal translation, and pitch, roll, and yaw rotation therebetween. The interaxle linkage 52 is shown assembled in the railway truck 10 in FIGS. 1 and 12 between each of the adjacent two axles, i.e. between the first end axle 18A and the middle axle 18C, and between the middle axle 18C and the second end axle 18B. The two interaxle linkages 52 are disposed symmetrically along the truck frame centerline axis CL at the lateral centers of the respective axles 18 to interconnect the adjacent axles 18 in solely the lateral, horizontal plane while allowing substantially unrestrained yaw rotation therebetween, as well as all other translation and rotation movements for otherwise allowing the separate axles 18 to operate with little restraint from the interaxle linkages 52.

Referring firstly to FIGS. 22 and 23, an exemplary embodiment of the interaxle linkage 52 is illustrated with it being understood that identical linkages 52 are identically mounted between respective ones of the axles 18. The interaxle linkage 52 includes a center link or frame 54 in the exemplary form of a lightweight A-frame having suitable lateral stiffness for accommodating the lateral forces carried between adjacent ones of the axles 18. The center frame 54 has a longitudinal centerline frame axis Fa, a proximal end 54*a* pivotally joined to one of the axles, such as the middle axle 18C, laterally symmetrically therewith along the center frame axis Fa which is generally aligned with the truck frame centerline axis CL. The center frame 54 also has a distal end 54*b* extending horizontally away from the one axde 18C and is vertically movable upon pivoting of the center frame 54 relative to the one axle 18C.

The linkage 52 further includes a center or dogbone bracket 56 having a proximal end 56*a* fixedly joined to an adjacent one of the axles, such as the second end axle 18B, illustrated in FIG. 12, and a distal end 56*b* adjoining the center frame distal end 54*b*. A pair of preferably identical shear pads 58, which may either be square or circular in configuration for example, fixedly join together the center frame 54 and the center bracket 56 on opposite sides of the center frame axis Fa for laterally interconnecting the center frame 54 and the center bracket 56 while allowing limited differential longitudinal movement therebetween upon shearing of the shear pads 58 to permit differential yaw movement Y between the axles 18. The shear pads 58 also allow limited roll, pitch, and vertical differential movement. In this way, the interconnected center frame and bracket 54,56 provide a virtual center aligned with the truck frame centerline axis CL to obtain symmetric movement around right-hand and left-hand curves.

In the exemplary embodiment illustrated in FIGS. 22 and 23, the interaxle linkage 52 is configured to be relatively lightweight yet provide the required interconnection between the center frame and bracket thereof for laterally interconnecting the adjacent axles 18. The center frame 54 preferably includes a pair of laterally spaced apart arms 54*c* at the distal end 54*b* thereof which receive therebetween the center bracket distal end 56*b*. The shear pads 58 are disposed laterally between sides of the center bracket 56 and respective ones of the center frame arms 54*c* for carrying lateral loads upon lateral movement of either the center frame 54 or the center bracket 56.

Figure 24:
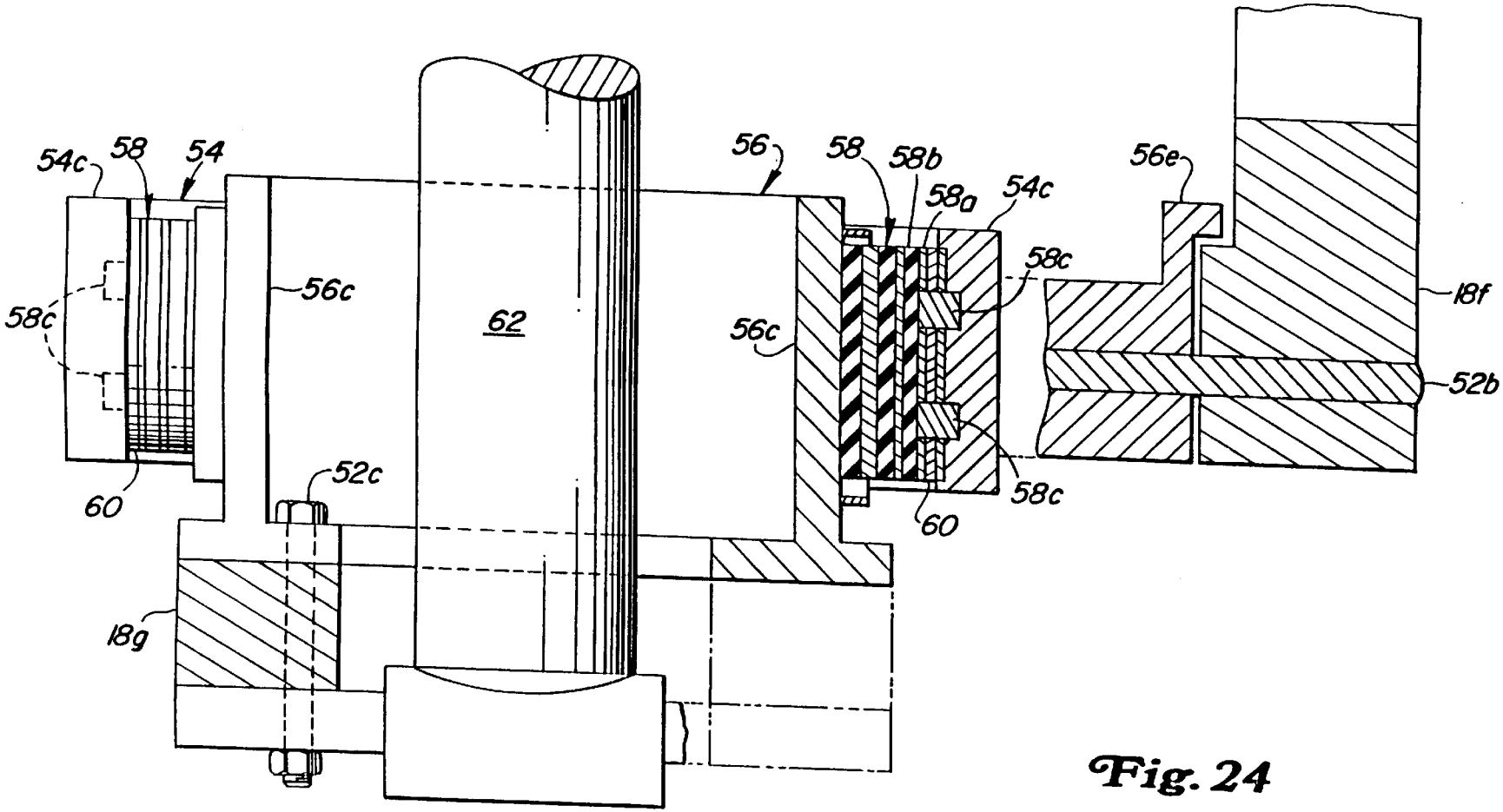
FIG. 24 is a partly sectional elevational view of the interaxle linkage illustrated in FIG. 22 and taken along the multi-cut line 24—24.

As illustrated in FIGS. 23 and 24, each of the shear pads 58 preferably includes a plurality of alternating layers of metal 58*a* and a suitable elastomer 58*b*, such as rubber, suitably bonded together for being stiff in compression and resilient in shear. Each of the shear pads 58 preferably includes one or more projecting studs 58*c* disposed in complementary mounting holes in the center frame arm 54*c*, and is precompressed against the center bracket 56.

In order to assemble and establish a suitable precompression of the shear pads 58, the linkage 52 further includes at least one slotted shim 60 disposed between one of the shear pads 58 and a respective center frame arm 54*c* as illustrated in FIG. 24. During initial assembly of the interaxle linkage 52, the individual shear pads 58 as illustrated in FIG. 23 are positioned between the cooperating faces of the center frame 54 and the center bracket 56, with the shear pad studs 58*c* being positioned into their respective mounting holes. The shear pads 58 may be suitably compressed so that one or more of the shims 60 may be inserted between the pads 58 and respective faces of the center frame arms 54*c* to take up the clearance therebetween and maintain the compression upon removal of the compressing equipment. A precompression of the shear pads 58 of at least 10,000 pounds is desirable in an exemplary embodiment.

As shown in FIGS. 23 and 24, a plurality of the shims 60 may be used and disposed on respective ones of the shear pads 58 for laterally symmetrically aligning the center bracket 56 with the center frame 54.

As shown in FIGS. 22 and 24, the center bracket 56 preferably includes a pair of laterally spaced apart legs 56*c* between its proximal and distal ends 56*a,b* to form a generally U-shaped bracket. The center bracket 56 is suitably fixedly joined to the adjacent axle, such as the second end axle 18B as illustrated in FIG. 1, at the bracket proximal end 56*a* for receiving therebetween a conventional suspension or dogbone link 62 which supports the traction motor 18*c* to the respective transom 14*c–e*. The center bracket legs 56*c* are disposed laterally between the center frame arms 54*c*, with the shear pads 58 being disposed respectively therebetween.

As shown in FIG. 23, the center frame 54 may also include a center hole 54*d* disposed equidistantly between the arms 54*c* thereof. The center bracket 56 correspondingly includes a center hole 56*d* disposed equidistantly between the legs 56*c* thereof at the center bracket distal end 56*b*. A suitable limit pin 52*a* extends vertically through the center holes 54*d* and 56*d* of the center frame and bracket 54, 56, and has a predetermined clearance therearound for limiting differential movement including translation and rotation between the center frame 54 and the center bracket 56 due to shearing of the shear pads 58. The limit pin 52*a* may be fixedly joined in the frame center hole 54*d* with a suitable clearance around the pin 52*a* being provided by the bracket center hole 56*d*.

The shear pads 58 operatively interconnect the center frame 54 and the center bracket 56 and are substantially stiff or rigid in compression and therefore ensure direct lateral movement between the center frame and bracket. However, the pads 58 are relatively soft in their shear directions, and as shown in FIG. 22 for example, differential relative movement between the center frame 54 and bracket 56 in the yaw direction Y will cause the respective shear pads 58 to deflect in shear longitudinally in opposite directions for accommodating either clockwise or counterclockwise yaw. This permitted yaw movement ensures that the self-steering linkage discussed above may operate as intended without obstruction from the interaxle linkages 52. However, the adjacent axles 18 are interconnected laterally which promotes the self-steering and hunting stability of the axles 18 also indicated above. The limit pin 52*a* is optional and may be used where desired for limiting the differential movement between the center frame 54 and bracket 56.

As indicated above, the center frame 56 is preferably in the form of an exemplary A-frame for providing lateral rigidity with reduced weight, and therefore includes a pair of laterally spaced apart legs 54*e*, as illustrated in FIGS. 22 and 23, which terminate at the proximal end 54*a* thereof, and are suitably pivotally joined to the one axle 18C for example. In the exemplary embodiment illustrated, each of the axles 18 includes a respective motor 18*c*, as illustrated in FIGS. 1 and 12, which is operatively joined thereto for powering the axles and wheels. As best shown for the second end axle 18B in FIGS. 1 and 2, each of the motors 18*c* has a corresponding motor housing 18*d* supporting the motor on one side of the axle 18, with the motor housing 18*d* being suitably joined to an axle housing 18*e* in the form of a U-tube on an opposite side of the axle 18 which collectively house both the motor 18*c* and the axle 18 itself.

As shown in FIG. 22, each axle housing 18*e* includes a pair of laterally spaced apart axle bosses or lugs 18*f* to which the center frame legs 54*e* are pivotally joined by retention pins 52*b* extending horizontally therethrough. The motor housing 18*c* as illustrated in FIG. 2 includes a pair of laterally spaced apart motor or dogbone bosses or lugs 18*g* which are conventionally provided for supporting the dogbone suspension links 62, while also supporting the center bracket legs 56*c* to which they are fixedly joined by conventional dogbone mounting bolts 52*c* as shown in FIGS. 22 and 24.

As shown in FIGS. 22 and 24, the distal end 54*a* of one of the center frame legs 54*e* preferably includes a L-shaped safety tab or catch 56*e* which is disposed vertically above a portion of the corresponding axle lug 18*f* for engaging the axle lug 18*f* upon failure or loss of both retention pins 52*b*. Since two retention pins 52*b* are provided for the two center frame legs 54*e*, each of the pins 52*b* provides redundancy by itself, with the safety catch 56*e* providing additional redundancy if desired.

As indicated above, the dogbone suspension link 62 illustrated in FIGS. 1 and 12 for example, is conventional and is conventionally pivotally joined between the motor lugs 18*g* (see FIG. 2 for clarity) and respective ones of the transoms 14*c–e* for suspending the corresponding motor 18*c* thereto. The suspension link 62 is positioned between the center bracket legs 56*c*, as shown in FIG. 24 for example, which provides a compact arrangement accommodating both the required suspension of the motors 18*c* and the desired interaxle linkage 52. In the exemplary three-axle truck 10 illustrated in FIGS. 1 and 12, a corresponding one of the interaxle linkages 52 is provided between the first end axle 18A and the middle axle 18C, and between the middle axle 18C and the second end axle 18B. In this way, all three axles 18A–C are laterally interconnected so that the leading axle in a curve laterally drives the trailing axles in the curve for improving hunting performance as well as improving self-steering as indicated above.

The interaxle linkage 52 illustrated in FIGS. 22–24 is relatively simple in configuration with relatively few joints and may be provided as an integral subassembly requiring simple connection to the corresponding axle and motor lugs 18*f,g*. Each individual axle 18 may be independently removed from the truck 10 by removing either the retention pins 52*b* or mounting bolts 52*c* from either or both ends of the interaxle linkage 52 as required. The first and second end axles 18A,B are joined to their corresponding interaxle linkages 52 at only one end, at the center frame 54 for the former and at the center bracket 56 for the latter. And, the middle axle 18C is joined to both adjoining interaxle linkages 52 which therefore requires disconnection from both in order for removing the middle axle 18C.

C-Section Truck Frame

A conventional railway truck frame configured for two-axle or three-axle operation must be suitably rigid for accommodating the various loads experienced during operation including static and dynamic vertical and lateral loads. Trucks configured for a locomotive require enhanced structural rigidity in view of the substantial traction loads which are carried in turn through the wheels, axles, side frames, and the interconnecting transoms.

Truck strength is therefore a primary consideration in truck design and has been historically obtained by using relatively simple box section frames. Box section railway truck frames have been conventionally manufactured as either a single casting, or a fabrication of components welded together. Fabrications are expensive due to the requirement to weld together all adjoining sections. Castings are lower cost, but are considerably heavier due to the attendant minimal wall thickness requirement and the perimeter required to define the box in the casting process.

Figure 25:
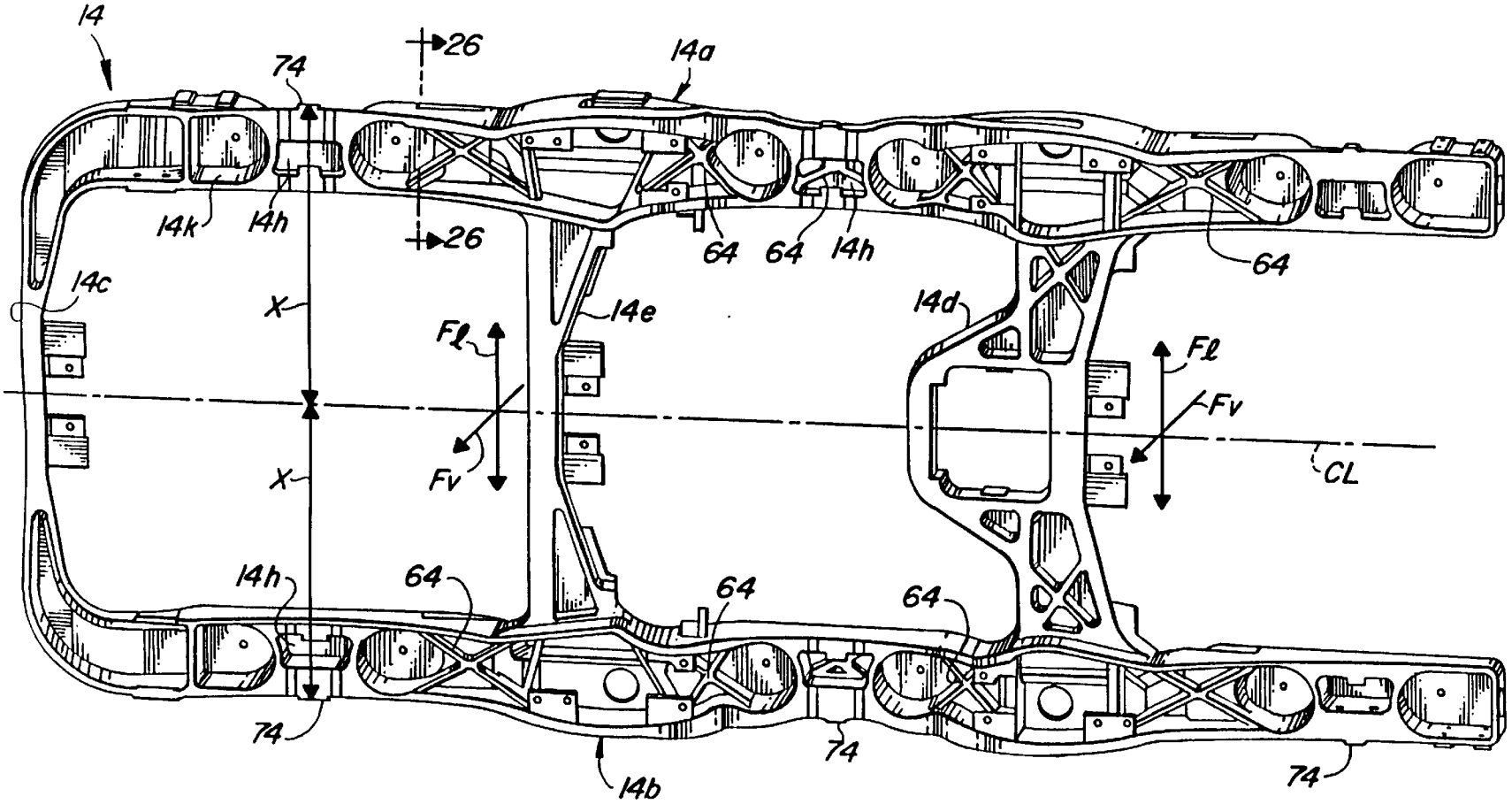
FIG. 25 is a generally plan view looking upwardly at the isolated truck frame in accordance with an exemplary embodiment of the present invention.

As introduced above with respect to FIGS. 1 and 12, the truck frame 14 has various improvements including the ability to contain therein a substantial portion of the self-steering linkage which is not possible in a conventional box section truck frame. FIG. 25 is an isolated view of the open bottom truck frame 14 wherein the side frames 14*a,b* have open C-sections at various locations thereof instead of conventional box sections. The truck frame 14 is laterally symmetrical about the frame centerline axis CL, with each of the side frames 14*a,b* being identical to each other in mirror image. The side frames 14*a,b* are configured for maximizing the number of C-sections along the longitudinal extent thereof, without using conventional enclosed box sections in accordance with the present invention. The side frames 14*a,b* must be suitably configured for providing the required rigidity of the truck frame 14 in combination with the interconnecting transoms 14*c–e*. And, they must be configured for mounting the several axles 18 thereto using the upper spring seats 14*k* in the form of blind pockets for receiving the upper ends of the coil springs 48 as described above with respect to FIG. 17, and configured also with the catch pockets 14*h* for receiving the catch hooks 40*g*.

Accordingly, frame strength is a primary consideration in designing an acceptable truck frame. Additional considerations also include frame weight, complexity and cost of manufacture by fabrication or casting, the ability to accurately inspect the manufactured frame, the ability to repair the frame. if required during manufacture, and packaging or envelope requirements of the frame itself and the various components which must share the limited available space in the railway truck.

The locomotive truck frame 14 will experience substantial longitudinal, vertical, and lateral loads during operation which subject the various components thereof to tension, compression, and bending. Conventional box sections provide good moment of inertia in bending both vertically and laterally for carrying the various loads generated during operation of the truck 10. However, box sections have inherent limitations which have been generally acceptable because of their obvious structural benefits. These limitations are found in casting, inspecting, repairing, and packaging of the frame.

Figure 27:
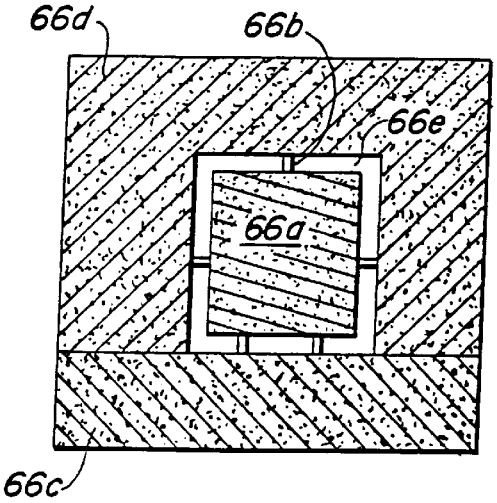
Fig. 27 (PRIOR ART)
FIG. 27 is an elevational sectional view of prior art casting components for conventionally casting a box section railway truck frame.

FIG. 27 illustrates an exemplary arrangement for conventionally casting the box section. A packed sand core 66*a* having the required inner configuration of the box section is supported around its perimeter using metal chaplets 66*b*. The chaplets 66*b* support the weight of the core 66*a* on a packed sand supporting drag 66*c*, and additional ones of the chaplets 66*b* laterally support the core 66*a* inside a packed sand cope 66*d* which defines with the drag 66*c* the outer configuration of the box section, with the spacing therebetween defining the box mold 66*e* in which molten metal is poured for forming the required box section resulting after cooling of the molten metal.

Cast box sections require floating the relatively large and fragile core 66*a* inside the molten metal envelope contained in the mold 66*e*. The metal chaplets 66*b* provide only initial support of the core 66*a* and melt during the casting process which allows the core 66*a* to float. This floating technique leads to large variations in dimensions of the resulting box sections which affect clearances and stresses in the frame. Cast box sections are difficult to inspect and repair since they are fully enclosed. To allow inspection, suitable core holes are strategically placed in the casting where sand would otherwise be permanently trapped or where weld repair is likely. Inspecting the wall thickness of the box section is manually impossible in view of the inability to access the interior of the box.

Accordingly, conventional ultrasound and x-ray techniques are used where possible for evaluating the quality and integrity of the frame at critical structural locations. Since the typical truck frame has various interconnecting components and discontinuities, ultrasound and x-ray measurements are often very difficult if not impossible to accomplish at all locations. One type of casting defect is known as a hot tear, and visual inspection thereof when found inside the box sections is typically ineffective. If hot tears are found, they are very difficult to weld repair due to the inability to access the inside of the box section. And, the box sections trap a significant volume of space in the truck frame which is not otherwise useful for accommodating various components of the truck. This space becomes more important as the locomotive industry strives for higher performance while limited by the static infrastructure of rail, tunnels, and bridges.

Figure 28:
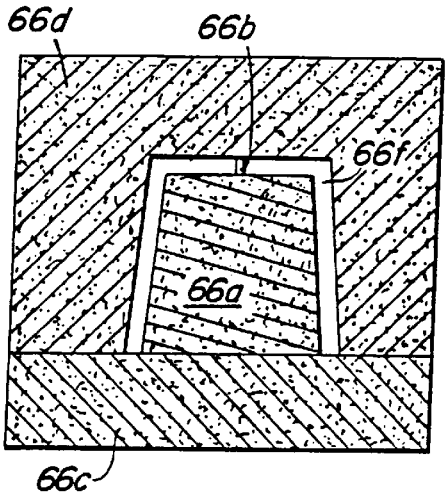
FIG. 28 is an elevational sectional view of casting components for casting the truck frame illustrated in FIGS. 25 and 26 with various C-sections therein in accordance with one embodiment of the present invention.
Figure 26:
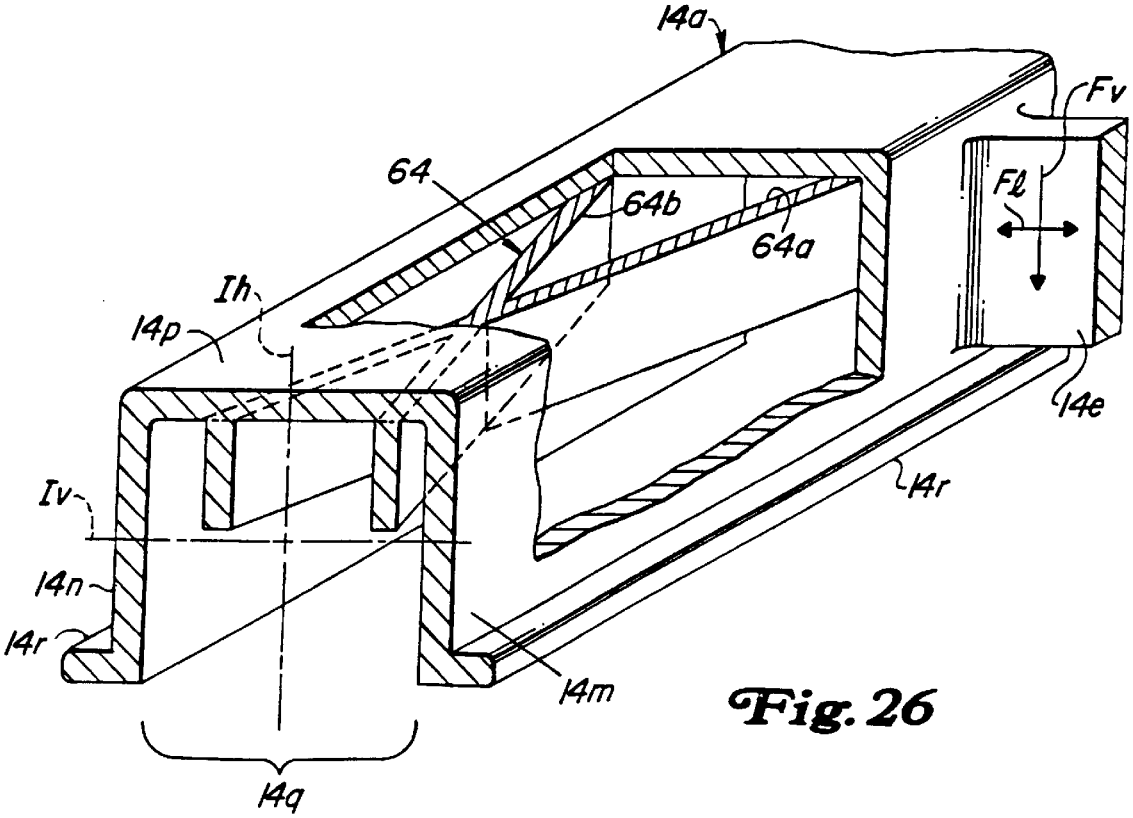
FIG. 26 is a partly sectional, isometric view of a portion of one of the side frames and transoms illustrated in FIG. 25 and taken generally along line 26—26.

The C-section truck frame 14 illustrated in FIGS. 25 and 26 in accordance with one embodiment of the present invention provides substantial improvements over the conventional box section truck frame. Significant improvements in castability of the C-section truck frame are readily apparent upon an examination of the corresponding casting components illustrated in FIG. 28 which are used for casting the C-section which is open along one of its four sides. In the exemplary embodiment illustrated in FIG. 28, the core 66*a* enjoys a positive contact on its entire lower surface which simply rests upon the drag 66*c* without chaplets therebetween. Few if any chaplets 66*b* are required and may be positioned atop the core 66*a* for supporting the center portion of the cope 66*d* thereabove. The corresponding C-section mold 66*f* merely faces downwardly atop the drag 66*c* and is conventionally filled with molten metal.

After the casting has been poured and cooled, the next step is to remove the core sand. The C-section resulting from the mold 66*f* is simply picked up, with the core sand simply dropping out by gravity. This is an improvement over the box section which must be shaken and bounced until the core sand is loosened and discharged through the required core holes typically using a vacuum for ensuring removal of the sand.

Inspection and weld repair are the next steps in manufacturing all steel castings. The C-section is easily accessed from underneath to measure wall thickness with a simple caliper, and to repair the walls as required. Since the C-section is visible from both outside and inside, inspection and repair is substantially improved. This is in contrast to the box section which can only be accessed through the required core holes. However, the core holes provide extremely limited access inside the box section, and wall thickness measurements are typically made using a conventional ultrasonic device, with evaluation of casting integrity being made through conventional x-rays of critical structural areas.

A typical square box section has equal bending moments of inertia along its principal horizontal and vertical axes for providing suitable structural stiffness against the corresponding vertical and lateral loads carried in the truck frame. However, the lateral load carrying capability of the box section is limited due to the ability of the box section walls to distort into a parallelogram. The C-section side frames 14*a,b* as illustrated for example in FIG. 26 may be configured for having effective vertical and horizontal bending moments of inertia for providing corresponding structural stiffness about these two principal axes, and may be additionally reinforced for increasing the lateral load carrying capability of the frame without undesirable distortion. Since the inside of the C-section frame is readily accessible, structural reinforcement may be integrally cast therein providing an additional improvement over the box section frame wherein the inside of a box is not accessible.

As shown in FIG. 26, each of the side frames 14*a,b* includes laterally spaced apart inboard and outboard sidewalls 14*m* and 14*n* which may take any suitable form such as flat or curved plates. The inboard sidewall 14*m* is integrally cast and thereby fixedly joined to respective ones of the transoms 14*c–e*, with a portion of the middle transom 14*e* being illustrated in FIG. 26. The C-section frame further includes a basewall 14*p* integrally cast and joined to the top ends of the inboard and outboard sidewalls 14*m,n*, with the opposite or bottom ends of the sidewalls defining an unobstructed frame inlet 14*q*. The sidewalls 14*m,n* and the basewall 14*p* collectively define the C-section of the side frame 14*a,b*. The C-section preferably faces downwardly, with the frame inlet 14*q* being accessible from below. In this configuration, the C-section is generally laterally symmetrical, with a vertical bending moment of Inertia $I_v$ associated with a horizontal neutral axis, and a horizontal bending moment of inertia $I_h$ associated with a vertical neutral axis. The C-section may be suitably configured so that its principal bending moments of inertia are at least comparable if not greater than the corresponding moments of inertia of a conventional box section.

FIG. 25 illustrates schematically exemplary lateral loads or forces Fl which act in the horizontal plane between the transoms 14*c–a* and the side frames 14*a,b*. And, exemplary vertical loads or forces Fv acting between the transoms and side frames are also illustrated. In FIG. 26, the lateral and vertical loads Fl, Fv are also illustrated schematically at the junction between the middle transom 14*e* and the first side frame 14*a*. Since the inside of the C-section is accessible, the C-section may be readily tuned to achieve greater lateral stiffness than that available in a conventional box section by suitably casting in crossbraces 64 where desired.

Lateral bending in a railway truck frame is experienced during curving and also during traction loading and is carried between the transoms and the side frames. The crossbraces 64 may therefore be provided in those regions of the truck frame requiring maximum strength and lateral load carrying capability. Since the truck frame 14 is symmetrical about the longitudinal centerline axis CL, the crossbraces 64 are preferably disposed in pairs in corresponding opposite locations in the side frame 14*a,b*. As shown generally in FIG. 25, and specifically in FIG. 26, at least one crossbrace 64 is fixedly joined to the sidewalls 14*m,n* inside each of the side frames 14*a,b* adjacent to respective ones of the transoms 14*c–e* where desired for laterally stiffening the truck frame therebetween.

The crossbraces 64 may take any suitable form, and in the exemplary embodiment illustrated in FIG. 26 each includes a pair of cross ribs or plates 64*a* and 64*b* which intersect each other and form an "X." The separate ribs 64*a,b* are inclined between the opposite sidewalls 14*m,n* and are integrally formed or cast therewith, and have upper edges integrally joined with the basewall 14*p*. The crossbraces 64 extend downwardly in the side frame 14*a,b* for as deep as desired, and in the exemplary embodiment illustrated in FIG. 26, extend only in part from the basewall 14*p* to the frame inlet 14*q*.

In this way, otherwise unavailable space in the side frames 14*a,b* may be reclaimed using the C-section frames in which various truck components may be contained. As disclosed above with respect to FIG. 6, the traction links 22 are disposed in most part inside the side frame C-sections vertically between the crossbraces 64 and the fame inlet 14*q*. Similarly, the bellcranks 20 may also be disposed in most part inside the side frame C-sections, in a region without crossbraces 64 for example. And, the reaction arms 24 may be disposed in most part outside the side frame C-sections and join the bellcranks 20 therein through suitable access holes in the outboard sidewall 14*n*.

The crossbraces 64 illustrated in FIG. 26 primarily provide lateral stiffening of the side frame 14*a,b*, and secondarily provide vertical stiffening as well. If desired, additional vertical stiffening may be provided by integrally forming with both inboard and outboard sidewalls 14*m,n* laterally projecting beads 14*r* which primarily add vertical stiffening to the side frames, and secondarily add additional lateral stiffening as well. The beads 14*r* may have any suitable shape such as bulbous in section for increasing stiffness. In the exemplary embodiment illustrated in FIG. 26, the beads 14*r* extend longitudinally along each side frame 14*a,b* as desired and project outwardly away from the center of the C-section for maximizing the available space inside the C-section, and improving the section strength.

Referring again to FIG. 25, the side frames 14*a,b* are specifically configured for accommodating various components of the truck 10 including the journal boxes 16 and coil springs 48 which define the primary suspension. Accordingly, the C-sections may be tailored differently along the longitudinal extent of the side frames 14*a,b* as required for mounting the various components, and as required for structural integrity. Nevertheless, the truck frame 14 is characterized by the absence of conventional box sections, with the primary structural sections thereof being formed using the C-sections in accordance with the present invention.

Since the three transoms 14*c–e* join together the opposite side frames 14*a,b*, enhanced structural stiffness at the joints therebetween is desired. As shown in FIG. 25, the C-sections preferably extend longitudinally along each of the side frames 14*a,b* forward and aft of each of the second and middle transoms 14*d,e*. And, a pair of longitudinally spaced apart crossbraces 64 are preferably disposed in each of the C-sections forward and aft of these transoms 14*d,e*. The transoms 14 are perpendicular to the respective side frames 14*a,b* and therefore greater lateral stiffness is required for accommodating the high bending loads carried therebetween. The first transom 14*c* which joins the closed end of the frame 14 smoothly transitions into the respective side frames 14*a,b* with a relatively large radius, and has corresponding C-sections which transition therebetween for providing suitable lateral structural stiffness.

Although the transoms 14*c–e* may take any suitable configuration, in the exemplary embodiment illustrated in FIG. 25 the transoms 14*c–e* have solid cross-sections at least adjacent to the longitudinal centerline axis CL of the truck frame 14, and do not require either box cross-sections or C-sections. As indicated above, the first transom 14*c* transitions from its solid center cross-section to the desired C-section as it merges with the ends of the side frames 14*a,b*. The second and third transoms 13*d,e* are suitably configured as structural trusses in a common horizontal plane for suitably carrying bending loads between the side frames 14*a,b*. The second and third transoms 14*d,e* therefore longitudinally spread their lateral loads along corresponding portions of the side frames 14*a,b*. The side frames therefore preferably include the crossbraces 64 at both forward and aft locations adjoining each of the transoms 14*d,e*.

As shown in FIG. 6, the longitudinally spaced apart crossbraces 64 adjacent to the middle transom 14*e* provide an unobstructed pocket In which the respective bellcranks 20 may be disposed, with a corresponding traction link 22 extending longitudinally therefrom toward its mating journal box 16, with the traction link 22 being disposed in most part inside the side frame 14*a,b* vertically between the crossbraces 64 and the frame inlet 14*q*. The cross braces 64 are preferably positioned on opposite sides of the bellcrank pocket to better accommodate traction forces transferred to the truck frame through the bellcranks 20 and the traction caps 28.

Accordingly, the open bottom C-section side frames 14*a,b* provide enhanced structural rigidity of the frame 14 while reclaiming otherwise lost space for use in mounting various components such as the self-steering linkage. Compared with a conventional box section frame, the C-section truck frame 14 of comparable strength may be up to about 20% less in weight. The C-section frame improves the casting process making it more accurate for obtaining more uniform wall thickness and at reduced cost. Inspection and repair of the C-section frame are also made easier for improving the quality of the frame at reduced cost. These as well as other advantages associated with the C-section frame may be obtained in any type of railway truck frame whether it includes self-steering linkage or not.

Railway Truck Assembly and Alignment

A significant advantage of the open bottom truck frame 14, journal boxes 16, and self-steering linkage disclosed above is the ability to preassemble the primary suspension and steering linkage into the frame 14 and prealign and tram the journal boxes independently of the substantially heavy axle, wheels, and motor combinations 18*a–c*. In this way the motor combos may be separately installed into the truck frame and thereby be prealigned and trammed therein, as well as being readily removable for performing maintenance without requiring the removal of the journal boxes and steering linkage therewith. This provides substantial improvements over the assembly of conventional railway locomotive trucks.

Figure 29:
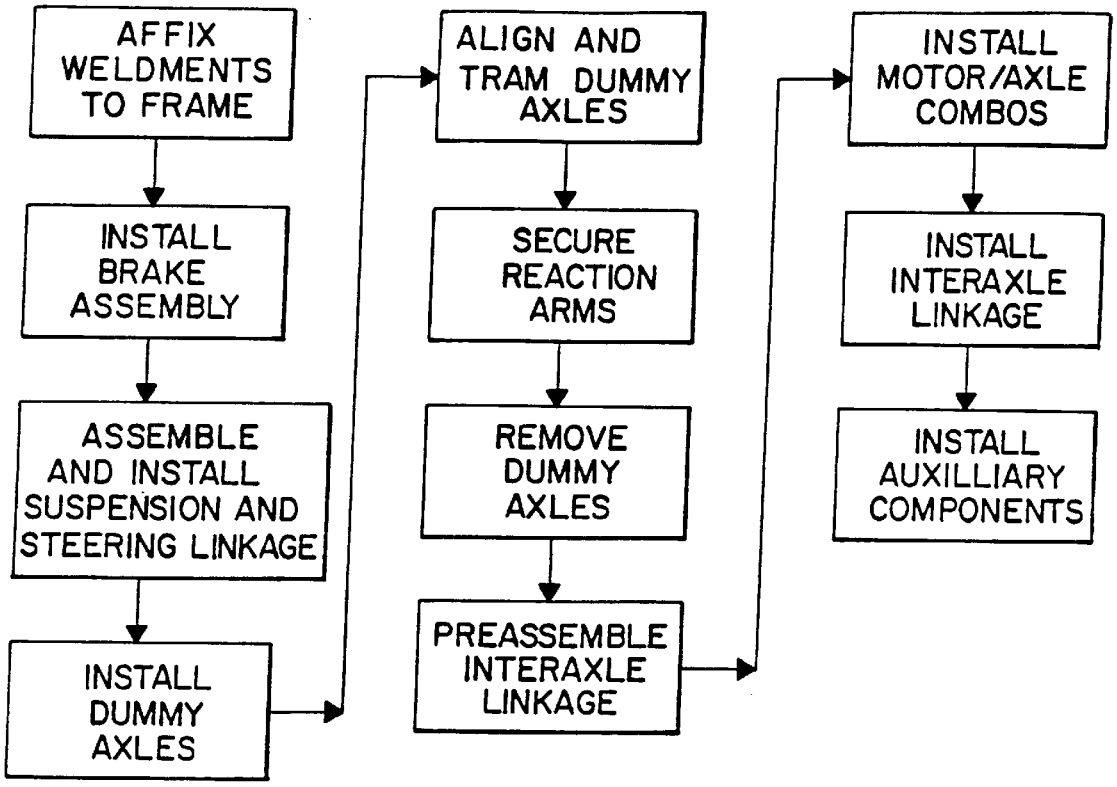
FIG. 29 is a flow chart representation of an exemplary process for assembling the truck illustrated in FIGS. 1 and 12.

Exemplary steps in assembling the railway truck 10 are presented in flow chart form in FIG. 29. The open bottom C-section truck frame 14 is firstly cast, inspected, and repaired as required in order to provide an acceptable truck frame 14 as shown in finished form in FIG. 25. The truck frame 14 is initially placed right side up, with its open bottom facing down towards the ground. And various truck weldments 68, some of which are shown in FIGS. 1 and 12, are conventionally affixed by welding to the frame 14. The weldments 68 are conventional and include for example brake brackets, top brackets for the primary dampers 46, turning fixture attachments, and other pieces used in the complete truck assembly. A conventional brake assembly 70, as illustrated in FIG. 12, is next installed into the truck frame 14 illustrated in FIG. 25.

The truck frame 14 is then turned over so that the open bottom end faces upwardly and the closed top of the frame faces downwardly so that the primary suspension and steering linkage may be readily installed. In the exemplary three-axle truck 10 illustrated in FIGS. 1 and 12, the end axles 18A,B are joined to the self-steering linkage, whereas the middle axle 18C is not. Accordingly, four separate subassemblies are made for each wheel location of the end axles 18A,B, with each including a respective end journal box 16, end traction link 22, and corresponding bellcrank 20, which components are shown in FIG. 2. And, two additional subassemblies of the middle journal boxes 16, middle traction links 22E and cooperating traction caps 28 as illustrated in FIG. 18 are also made. All of the coil springs 48, shown in FIG. 17, are then placed in their respective upper spring seats 14*k* in the truck frame 14. Each of the four end journal box subassemblies are then positioned over their respective springs 48 with the corresponding bellcranks 20 being mounted into their top bearings 26*a* preinstalled in the frame, see FIGS. 6 and 8, with the corresponding end traction links 22 being positioned in respective frame inlets 14*q* over the corresponding crossbraces 64 as illustrated in FIG. 6 for example. Similarly, the middle journal boxes 16 are positioned over their respective coil springs 48.

Each of the six journal boxes 16 is then secured to the frame 14 by using a suitable hydraulic press for compressing the respective journal box housings 40 against the respective coil springs 48 until the respective catch hooks 40*g* are positioned in their respective pockets 14*h* as shown in FIG. 17, with the catch pins 50 then being installed. The press may then be released allowing the catch hooks 40*g* to rest against the catch pins 50 for mounting the journal box housings 40 to the frame 14, with the coil springs 48 being precompressed therebetween.

Each of the respective bellcranks 20 as shown in FIGS. 6 and 8 are finally assembled into the respective side frames 14*a,b*, with the respective traction caps 28 being suitably bolted thereto. The individual reaction arms 24, as shown in FIG. 6 for example, are then installed to their respective crankshafts 20*a*, with the distal ends 24*b* of the respective reaction arms 24 being disposed adjacent to each other without completing the joint 32 therebetween.

The primary suspension and self-steering linkage are installed to the frame 14 without the axles 18 and the housing caps 42, and without the reaction arm 24 being finally assembled together. At this stage of the assembly process, all six journal boxes 16 may be prealigned and pretrammed so that upon installation of the motor combos 18*a–c*, the axles and wheels thereon will be automatically aligned and trammed relative to each other and to the truck frame 14. This is a substantial improvement over a conventional assembly process where the motor combos are preinstalled into their respective journal boxes outside of the truck frame, and then these entire assemblies are mounted and aligned in the truck frame which is relatively difficult in view of the substantial weight involved and close quarters of the components.

Figure 30:
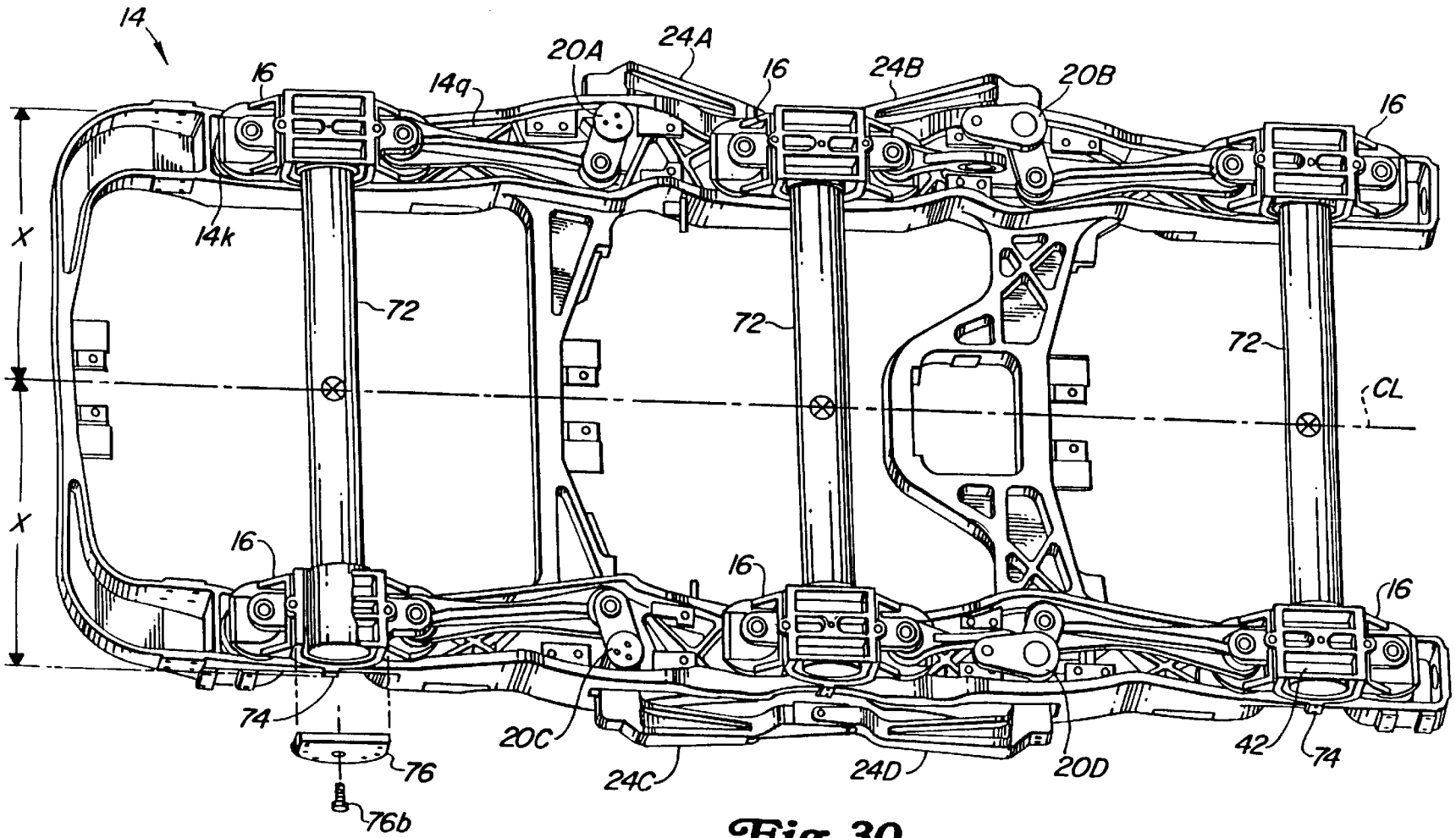
FIG. 30 is a plan view of the truck frame illustrated in FIG. 25 having installed therein the journal boxes, steering linkage, and dummy axles used for aligning and tramming the axles in the frame.

In order to prealign the axles 18, it Is desirable to use dummy axles 72 instead of the original or operative axles, wheels, and motor combos 18*a–c* to improve the process. An exemplary embodiment of the dummy axles 72 is illustrated In FIG. 30 and is in the form of a preferably one-piece shaft having opposite distal ends which are machined to match the outer diameter and configuration of the corresponding axle bearings 18*a* of the original axles 18 as illustrated in FIG. 15 for example. The dummy axles 72 resemble the actual or original axles 18 in the sense that they engage into the bearing seats 40*b* of the journal box housings 40 (see FIG. 16) in the same manner as the actual bearings 18*a*, and have the same length between opposing journal boxes 16 as the original axle 18. The dummy axles 72 do not Include actual axle bearings 18*a* or wheels 18*b* or motors 18*c* therewith. Accordingly, the dummy axles 72 are substantially simpler and compact in configuration and weigh substantially less than the original motor combos 18*a–c*. They therefore may be more readily handled during the alignment process and provide substantial clearance therearound making alignment easier.

The three dummy axles 72 required for the three axle truck frame 14 illustrated in FIG. 3 are installed into their respective journal boxes 16 to directly correspond with the original axles and bearings 18*a,b* for which they are designed to represent. Prealignment and tramming may then be effected using the dummy axles 72.

Alignment and tramming are conventional terms used to describe the longitudinal alignment of the wheels 18*b* on each side of the truck frame 14, and the squareness of the positions of the wheels 18*b* to form an accurate rectangle. In a preferred embodiment, all three dummy axles 72 illustrated in FIG. 30 are initially center aligned laterally in the truck frame 14 relative to the frame centerline axis CL. In this regard, the truck frame 14 is provided with accurately machined alignment tabs 74 on the outboard faces thereof at each of the catch pockets 14*h* as shown more clearly in FIG. 25. The alignment tabs 74 are machined so that they may be used to define accurate and equal reference lengths X to accurately define the frame centerline axis CL.

A special alignment end plate 76 as illustrated in FIG. 30 is provided for each of the journal boxes 16 and is mounted to the journal box housing 40 in place of the end plates 44 illustrated in figure 15 so that each dummy axle 72 may be accurately centered in the frame 14 relative to the frame centerline axis CL. The alignment plate 76 includes a threaded aperture through which extends a corresponding alignment bolt 76*b* which is positioned to engage the end of a respective one of the alignment tabs 74. In this way, the alignment bolts 76*b* on opposite sides of each dummy axle 72 may be threadingly adjusted to in turn laterally translate the respective journal box housings 40 and in turn translate the dummy axle 72 until its longitudinal center is aligned with the frame centerline axis CL within a preferred tolerance of about 20 mils for example. In this way, the opposite distal ends of the dummy axles 72 will be longitudinally aligned with each other. Lateral adjustment of the end dummy axles 72 is simply accomplished by lateral adjustment of the corresponding journal boxes 16 in which they are supported, which in turn is readily accomplished by pivoting the respective reaction arms 24 about the respective bellcranks 20.

Once all three dummy axles 72 are center aligned in the truck frame 14, the alignment bolts 76*b* for the middle dummy axle 72 are preferably maintained tight against the alignment tabs 74 for securing the position of the middle dummy axle 72, and the alignment bolts 76*b* for the end dummy axles 72 are preferably lightly unthreaded to allow limited lateral movement of the end dummy axles 72 during the tramming process. Tramming ensures that the dummy axles 72 are square or perpendicular relative to the collective rectangle being defined by the opposite distal ends thereof.

Although the dummy axles 72 may be longitudinally aligned at their respective ends, they may collectively define a parallelogram which is not the desired rectangle. Tramming, or squaring, ensures that the dummy axles 72 collectively define an accurate rectangular configuration. As shown schematically in FIG. 31, tramming may be effected by ensuring that either the two long diagonals $D_1$ between each end dummy axle 72 and the middle dummy axle 72 are equal in length, or that the two short diagonals $D_2$ between each of the end dummy axles 72 and the middle dummy axle 72 are also equal. Tramming may be readily effected by simply rotating the respective reaction arms 24 about their corresponding bellcranks 20 to in turn laterally and longitudinally adjust each of the journal boxes 16 which support the respective dummy axles 72.

Although tramming of the three dummy axles 72 may be accomplished without first centering the middle dummy axle 72, it would be substantially more complex due to the interrelationship of centering and tramming, and due to the coupled lateral translation and yaw rotation of the dummy axles 72 upon rotation of the respective reaction arms 24. Accordingly, in the preferred embodiment as described above, the tramming process is more effectively and easily accomplished by firstly center aligning the middle dummy axle 72 followed in turn by center aligning the end dummy axles 72 relative to the middle dummy axie, and then tramming the end dummy axles relative to the middle dummy axle.

Figure 31:
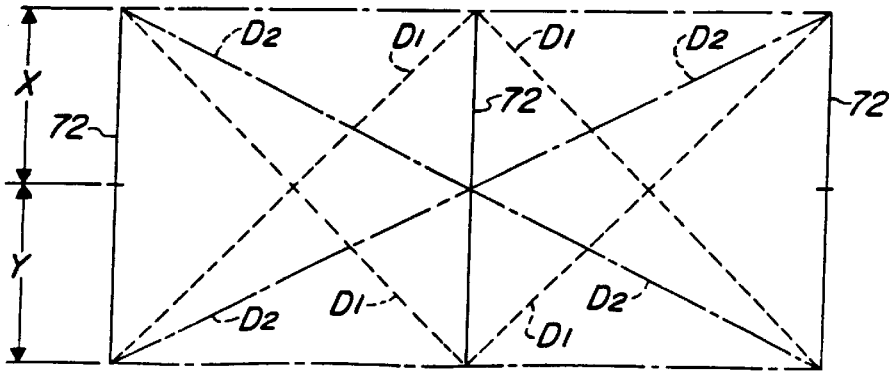
FIG. 31 is a schematic representation of the dummy axles disposed in the truck frame illustrated in FIG. 30 for effecting alignment and tramming thereof.

Once the three dummy axles 72 are trammed to form the desired rectangular configuration illustrated schematically in FIG. 31, the adjoining reaction arms 24 may then be fixedly joined together using the joint 32 therefor. As disclosed above with respect to FIGS. 10 and 11, the Ishim plates 32*g* are selected in size and installed on either or both sides of the shear pads 32*e* as required so that the center bore of the wing plate 32*c* is vertically aligned with the corresponding aperture in the fork 32*a* so that the retention pin 32*d* may be installed. The clamping plate 32*f* and the retention pin 32*d* securely join together the adjoining distal ends 24*b* of adjacent reaction arms 24 for locking in position the four respective end journal boxes 16. The dummy axles 72 are then removed from the journal boxes 16 which leaves the journal boxes 16 in a prealigned and pretrammed position for accepting the original axles 18 to ensure their accurate alignment and tramming in the assembled truck 10. The original axles 19 including bearings 18*a*, wheels 18*b*, and motors 18*c* may then be simply installed into the corresponding journal boxes 16, and thereby are prealigned and trammed.

The interaxle linkage 52 illustrated in FIGS. 22 and 23 may then be preassembled as another subassembly and then installed to the adjoining motor and axle housings 18*d,e* as described above. The respective dogbone suspension links 62 are installed with the interaxle linkages 52 for completing the interconnection between the adjacent motors 18*c*. The corresponding housing caps 42, illustrated in FIG. 12 for example, are then installed on each of the journal boxes 16 to secure the axles 18 therein.

Since the self-steering linkage is now operatively joined together at the joints 32 shown in FIG. 9, the balancing cross arms 34*a* and cross link 34*b* illustrated in FIG. 12 for example may now be installed on the respective bellcranks 20B,D. The respective crank arms 34*a* may be conventionally press fit to the respective bellcranks 20B,D to ensure that no initial tension or compression load exists in the cross link 34*b*.

The truck 10 at this stage of the assembly process is then suitably rolled over into its right side up orientation as illustrated in FIG. 1 for example, and then all remaining or auxiliary a components are then installed in the truck 10. For example, the end plates 44 and corresponding dampers 46 may then be installed. And any remaining conventional components may then be installed as desired.

As indicated above, the improved journal boxes 16 therefore allow prealignment of the corresponding journal boxes 16 by adjustment of the respective reaction arms 24 for ensuring that when the operative axles 18 are finally installed into the journal boxes 16, that they are accurately center aligned and trammed relative to the truck frame 14. In a maintenance outage for example, the individual axles 18 may be readily removed by removing the respective housing caps 42 and suitably dropping the axles 18 from below the truck frame 14 over a conventional drop table. The journal boxes 16 themselves and the corresponding self-steering linkage need not be removed for removing the axles 18. And, upon reinstallation of the axles 18, realignment and tramming is not required since the original alignment and tramming is maintained by the journal boxes 16 and self-steering linkage which have not been removed.

The various features of the improved truck 10 described above provide substantial improvements over conventional railway trucks. The improvements may be used in various alternative forms and in various combinations for both non-steering and self-steering railway trucks as desired. As used in the exemplary three axle truck 10 disclosed above, the various components provide a compact and relatively light weight package which more effectively utilizes space found within the envelope of the truck frame 14 for providing the various advantages disclosed above.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A journal box for mounting an axle to a side frame in a railway truck comprising:

a U-shaped housing for being resiliently suspended from said side frame including a downwardly facing cap seat, a downwardly facing bearing seat disposed vertically above said cap seat for receiving a bearing attached to an end of said axle; and a removable housing cap fixedly joined to said cap seat for retaining said bearing in said bearing seat;

wherein said housing cap comprises a plate having a plurality of upwardly raised arcuate retention lands for adjoining said bearing and retaining said bearing in said housing.

2. The journal box of claim 1, wherein said housing cap further comprises a plurality of threaded apertures formed therethrough operable to engage a plurality of bolts for the disassembly of said housing cap from said housing.

3. A journal box for mounting an axle to a side frame in a railway truck for carrying traction loads therebetween through traction links comprising:

a U-shaped housing for being resiliently suspended from said side frame including a downwardly facing cap seat, an opposite bearing seat disposed vertically above said cap seat for receiving an end of said axle, an inboard aperture through which said axle extends, and an opposite outboard aperture;

a removable housing cap fixedly joined to said cap seat for retaining said axle end in said bearing seat and stiffening said housing, wherein said axle includes a bearing rotatable mounted to a distal end thereof, and said bearing seat is configured for receiving an arcuate upper portion of said bearing, with said housing cap being configured for adjoining at least an arcuate lower portion of said bearing for allowing assembly and disassembly of said axle with said housings; and an end plate removably fixedly joined to said housing over said outboard aperture for fixedly joining a damper to said end plate and said side frame for damping vibration between said truck and said journal box.

4. The journal box of claim 3, wherein said end plate comprises:

an inboard face having a means for transferring loads from said end plate to said housing; and an outboard face having a means for connecting said damper to said end plate.

5. The journal box of claim 3, wherein said end plate further comprises a central hole formed therein.

6. A journal box according to claim 3 wherein said end plate comprises:

an inboard face having an arcuate end ridge being complementary with said housing outboard aperture and disposed therein in abutting contact therewith for carrying vertical loads from said end plate to said housing; and an outboard face having a pair of spaced apart end gussets extending outboard therefrom for fixedly supporting said damper thereto.

7. A journal box for mounting an axle to a side frame in a railway truck for carrying traction loads therebetween through traction links comprising:

a U-shaped housing for being resiliently suspended from said side frame including a downwardly facing cap seat, an opposite bearing seat disposed vertically above said cap seat for receiving an end of said axle, an inboard aperture through which said axle extends, and an opposite outboard aperture;

a removable housing cap fixedly joined to said cap seat for retaining said axle end in said bearing seat and stiffening said housing, wherein said axle includes a bearing rotatably mounted to a distal end thereof, and said bearing seat is configured for receiving an arcuate upper portion of said bearing, with said housing cap being configured for adjoining at least an arcuate lower portion of said bearing for allowing assembly and disassembly of said axle with said housings;

a catch hook extending vertically unwardly from said housing for being received in a catch pocket in said side frame through which extends a catch pin below a Portion of said catch hook to limit vertical downward travel of said journal box relative to said side frame;

said catch hook being sized relative to said catch socket and position of said catch pin to limit longitudinal and lateral travel of said journal box relative to said side frame, wherein said catch hook is T-shaped for being disposed between a pair of catch pins on opposite sides thereof for limiting both vertical and longitudinal travel of said catch hook in said catch pocket.

8. A journal box for mounting an axle to a side frame in a railway truck for carrying traction loads therebetween through traction links comprising:

a U-shaped housing for being resiliently suspended from said side frame including a downwardly facing cap seat, an opposite bearing seat disposed vertically above said cap seat for receiving an end of said axle, an inboard aperture through which said axle extends, and an opposite outboard aperture;

a removable housing cap fixedly joined to said cap seat for retaining said axle end in said bearing seat and stiffening said housing, wherein said axle includes a bearing rotatable mounted to a distal end thereof, and said bearing seat is configured for receiving an arcuate upper portion of said bearing, with said housing cap being configured for adjoining at least an arcuate lower portion of said bearing for allowing assembly and disassembly of said axle with said housings; and a pair of wings extending oppositely from said journal box housing adjacent said bearing seat, each wing including an upwardly facing lower spring seat for supporting a coil spring between said lower spring seat and said side frame for vertically supporting said side frame on said journal box, further comprising a pair of ledges extending oppositely from said journal box housing adjacent said bearing seat and generally parallel with said wings for fixedly joining respective ends of said traction links to said journal box.

9. A journal box according to claim 8 wherein respective ones of said wings and ledges are vertically spaced apart for vertically retaining a respective end of one of said traction links therebetween for joining said one of said traction links to said journal box generally coplanar with an axis of rotation of said bearing.

10. A journal box according to claim 9 wherein said respective ones of said wings and ledges include vertically aligned holes for receiving a link pin extending therethrough and through said traction link end.

11. A journal box according to claim 10 wherein said oppositely extending pairs of wings and ledges are identical to each other.

12. A journal box for mounting an axle having a bearing thereon to a side frame in a railway truck for carrying loads to a traction link comprising:

a U-shaped housing having a downwardly facing cap seat and a downwardly facing bearing seat disposed vertically above said cap seat for receiving said bearing;

a removeable housing cap fixedly joined to said cap seat for retaining said bearing in said bearing seat;

a wing extending from said housing including an upwardly facing lower spring seat for supporting a spring between said lower spring seat and said frame;

a ledge spaced from said lower spring seat and extending from said housing for attaching said traction link to said housing in a position generally coplanar with an axis of rotation of said bearing.

13. The journal box of claim 12, further comprising:

an end plate attached to said housing proximate an end of said axle;

a means for connecting a damper between said end plate and said frame.

14. The journal box of claim 13, further comprising a hole formed in said end plate proximate said axle end.

15. The journal box of claim 12, further comprising:

a T-shaped catch hook attached to said housing for being disposed in a catch pocket between a pair of catch pins extending from said frame for limiting the travel of said housing relative to said frame.

16. The journal box of claim 12, wherein said wing comprises a first wing and said ledge comprises a first ledge, and further comprising:

a second wing identical to said first wing attached to said housing on an opposed side of said housing from said first wing; and a second ledge identical to said first ledge attached to said housing on an opposed side of said housing from said first ledge.

* * * * *